US008910895B2

(12) United States Patent
Masuda

(10) Patent No.: US 8,910,895 B2
(45) Date of Patent: Dec. 16, 2014

(54) CABLE WINDING DEVICE

(71) Applicant: Sony Corporation, Tokyo (JP)

(72) Inventor: Akira Masuda, Saitama (JP)

(73) Assignee: Sony Corporation, Tokyo (JP)

( * ) Notice: Subject to any disclaimer, the term of this patent is extended or adjusted under 35 U.S.C. 154(b) by 152 days.

(21) Appl. No.: 13/667,436

(22) Filed: Nov. 2, 2012

(65) Prior Publication Data

US 2013/0119178 A1 May 16, 2013

(30) Foreign Application Priority Data

Nov. 9, 2011 (JP) ..... 2011-245719

(51) Int. Cl.
*B65H 75/48* (2006.01)
*B65H 75/44* (2006.01)

(52) U.S. Cl.
CPC ..... *B65H 75/48* (2013.01); *B65H 75/4428* (2013.01); *B65H 75/4434* (2013.01); *B65H 2701/3919* (2013.01)
USPC ..... 242/378; 242/378.1; 242/378.2; 242/378.3; 242/378.4

(58) Field of Classification Search
USPC ..... 242/378, 378.1–378.4
See application file for complete search history.

(56) References Cited

U.S. PATENT DOCUMENTS

| | | | | |
|---|---|---|---|---|
| 7,384,013 | B2 * | 6/2008 | Yen | 242/378 |
| 7,490,791 | B1 * | 2/2009 | Yen | 242/378.1 |
| 2006/0011763 | A1 * | 1/2006 | Kuo | 242/378.1 |
| 2006/0243845 | A1 * | 11/2006 | Wegner | 242/378.1 |

FOREIGN PATENT DOCUMENTS

JP 2003-112857 A 4/2003

* cited by examiner

*Primary Examiner* — Sang Kim
(74) *Attorney, Agent, or Firm* — Sony Corporation

(57) ABSTRACT

Disclosed herein is a cable winding device including: a base member disposed in a fixed state; a winding reel that is connected to part of a cable and that can be rotated relative to the base member in a winding direction and an unwinding direction; a lever supported on the winding reel and rotated together with the winding reel relative to the base member; a biasing member biasing the winding reel in the winding direction; a rotatable member that is disposed to face the base member, that can be rotated around a fulcrum axis relative to the base member, and that has a control part operative to control winding of the cable; and a control rib located on a locus of rotation of the rotatable member. The winding of the cable is controlled according to the position of the control part relative to the control rib.

18 Claims, 27 Drawing Sheets

CABLE WINDING DEVICE

CROSS-REFERENCE TO RELATED APPLICATION

The present application claims priority from Japanese Patent Application No. JP 2011-245719 filed in the Japanese Patent Office on Nov. 9, 2011, the entire content of which is incorporated herein by reference.

BACKGROUND

The present technology relates to a technical field of a cable winding device. More particularly, the technology relates to a technical field for controlling the winding of a cable according to the position of a control section for a rotatable member relative to a control rib located on a locus of rotation of the rotatable member, so as to secure reliability of operation while promising a simplified mechanism and enhanced durability.

There has been known a cable winding device in which a winding reel is rotatably disposed inside a casing and by which a cable can be wound around and unwound from the winding reel (see, for example, Japanese Patent Laid-open No. 2003-112857).

In the cable winding device described in Japanese Patent Laid-open No. 2003-112857, in which the winding reel is rotatably disposed inside the casing, the winding reel is provided with a cam and the casing (lower case) is provided with a plurality of eccentric cams (ribs) which extend in a circumferential direction and are spaced apart in a radial direction.

A lever is turnably supported on the lower case, and such modes as a winding mode and a stop mode are each set by swingable engagement of the lever with one of the cams.

SUMMARY

In the cable winding device described in Japanese Patent Laid-open No. 2003-112857, however, the plurality of cams are provided which extend in the circumferential direction and are eccentric with reference to a center of rotation of the winding reel. In addition, since the number of the cams provided is large, this configuration hampers simplification of mechanism.

Besides, in the cable winding device as above-mentioned, winding and unwinding of the cable and stopping of the winding are carried out repeatedly, so that it is necessary to secure operation reliability during these operations.

The above-mentioned type of cable winding devices include those in which a spherical element (iron ball) functioning as a bearing is moved while being guided by a recessed groove during each of the operations. In a cable winding device in which such a spherical element is used, lowering in durability may arise, for example, from wear of the spherical element due to repeated operations.

There is a need for a cable winding device by which it is possible to solve the above-mentioned problems and to secure reliability of operation while ensuring a simplified mechanism and enhanced durability.

According to an embodiment of the present technology, there is provided a cable winding device including: a base member disposed in a fixed state; a winding reel that is connected to part of a cable and that can be rotated relative to the base member in a cable winding direction and a cable unwinding direction reverse to the cable winding direction; a lever supported on the winding reel and rotated together with the winding reel relative to the base member; a biasing member biasing the winding reel in the winding direction; a rotatable member that is disposed to face the base member, that can be rotated relative to the base member with a fulcrum axis as a fulcrum, the fulcrum axis being located coaxially with a rotational axis of the winding reel, and that has a control part operative to control winding of the cable; and a control rib located on a locus of rotation of the rotatable member, in which the winding of the cable is controlled according to the position of the control part relative to the control rib.

In this configuration, the rotatable member is rotated with the fulcrum axis (which is located coaxially with the rotational axis of the winding reel) as a fulcrum, and the position of the control part relative to the control rib is changed, whereby winding of the cable is controlled.

In the above-mentioned cable winding device, preferably, regions on circumferentially opposite sides of the control rib are respectively a first region and a second region, the rotatable member is rotated and the control part is moved from the first region into the second region when the cable is unwound and the winding reel is rotated in the unwinding direction, and the control part is moved from the second region into the first region when the rotatable member is rotated in the winding direction by a biasing force of the biasing member in a condition where the control part has been moved from the first region into the second region.

The control part is moved from the first region into the second region when the winding reel is rotated in the unwinding direction, and the control part is moved from the second region into the first region when the rotatable member is rotated in the winding direction, whereby the position of the control part is changed depending on the operation performed on the cable.

In the above-mentioned cable winding device, preferably, the base member has a rotation-restraining part, the lever has a to-be-stopped part, and when the rotatable member is rotated in the winding direction and the control part is moved from the second region into the first region, the to-be-stopped part is engaged with the rotation-restraining part, whereby the winding reel is restrained from being rotated in the winding direction.

When the rotatable member is rotated in the winding direction and the control part is moved from the second region into the first region, the to-be-stopped part is engaged with the rotation-restraining part, whereby the winding reel is restrained from being rotated in the winding direction. Thus, the rotation of the winding reel is restrained by the movement of the control part.

In the above-mentioned cable winding device, preferably, in a condition where the control part is located in the first region, the winding reel is rotated in the winding direction by the biasing force of the biasing member, whereby the cable is wound.

In a condition where the control part is located in the first region, the winding reel is rotated in the winding direction by the biasing force of the biasing member, whereby the cable is wound. Thus, the cable is wound depending on the position of the control part.

In the above-mentioned cable winding device, preferably, the rotatable member has a to-be-restrained section, a restraint rib that can be engaged with the to-be-restrained section and that restrains rotation of the rotatable member when in engagement with the to-be-restrained section is provided between the first region and the second region, and the to-be-restrained section is engaged with the restraint rib and the control part is held in the first region when the rotatable member is rotated during winding of the cable.

When the rotatable member is rotated during winding of the cable, the to-be-restrained section is engaged with the restraint rib and the control part is held in the first region. Thus, the to-be-restrained section contacts with the restraint rib, whereby the rotation of the rotatable member is restrained.

In the above-mentioned cable winding device, preferably, the restraint rib is formed in a shape extending in a radial direction of the rotatable member, and the restraint rib is located over a range from an innermost circumference to an outermost circumference of the rotatable member.

The restraint rib is formed in the shape extending in the radial direction of the rotatable member, and the restraint rib is located over the range from the innermost circumference to the outermost circumference of the rotatable member, whereby the to-be-restrained section is engaged with the restraint rib when the rotatable member is rotated.

In the above-mentioned cable winding device, preferably, the control rib and the restraint rib are located on opposite sides of the rotational axis.

The control rib and the restraint rib are located on opposite sides of the rotational axis, whereby the first region and the second region are equal in size.

In the above-mentioned cable winding device, preferably, the lever has a sliding part, an outer circumferential surface of the rotatable member is an active surface to be slidably engaged with the sliding part of the lever, the active surface has an engagement part that is smaller than the outermost circumference of the rotatable member in radial distance from the fulcrum axis, and the to-be-stopped part is engaged with the rotation-restraining part through engagement of the sliding part of the lever with the engagement part.

The active surface has the engagement part that is smaller than the outermost circumference of the rotatable member in radial distance from the fulcrum axis, and the to-be-stopped part is engaged with the rotation-restraining part through engagement of the sliding part of the lever with the engagement part, whereby the rotation of the lever is restrained when the sliding part is engaged with the engagement part.

In the above-mentioned cable winding device, preferably, the lever is turnably supported on the winding reel, and a biasing spring configured to bias the lever in a direction for the sliding part to be pressed against the active surface is provided.

The lever is turnably supported on the winding reel, and the biasing spring configured to bias the lever in the direction for the sliding part to be pressed against the active surface is provided, whereby the sliding part is let slide on the active surface when the rotatable member is rotated.

In the above-mentioned cable winding device, preferably, the rotatable member has a displaceable section that includes the control part and that is elastically deformable in directions for coming closer to and away from the control rib, and the displaceable section is elastically deformed when the rotatable member is rotated, whereby the control part is let slide on the control rib and is moved on both sides of the control rib.

The displaceable section is elastically deformed when the rotatable member is rotated, whereby the control part is let slide on the control rib and is moved on both sides of the control rib. Thus, the displaceable section is elastically deformed and the control part is moved between the first region and the second region.

In the above-mentioned cable winding device, preferably, the rotatable member has the displaceable section that includes the control part and that is elastically deformable in the directions for coming closer to and away from the control rib, the displaceable section is elastically deformed when the rotatable member is rotated, whereby the control part is let slide on the control rib and is moved on both sides of the control rib, part of the lever is disposed between the base member and the rotatable member, and, when the control part is located in the first region and the lever is located between the base member and the displaceable section of the rotatable member, elastic deformation of the displaceable section is restrained by the lever and the control part is held in the first region.

When the control part is located in the first region and the lever is located between the base member and the displaceable section of the rotatable member, elastic deformation of the displaceable section is restrained by the lever and the control part is held in the first region, whereby the need for any member for exclusive use to restrain elastic deformation of the displaceable section is eliminated.

In the above-mentioned cable winding device, preferably, the rotatable member has an unwinding-side rotation-permitting section that is engaged with the sliding part and that permits rotation of the rotatable member and the lever as one body in the unwinding direction, and the base member has an unwinding cam part that releases or avoids engagement of the sliding part with the unwinding-side rotation-permitting section so as to permit the lever to be rotated in the unwinding direction relative to the rotatable member.

The base member has the unwinding cam part that releases or avoids engagement of the sliding part with the unwinding-side rotation-permitting section so as to permit the lever to be rotated in the unwinding direction relative to the rotatable member, whereby the engagement of the sliding part with the unwinding-side rotation-permitting section is released or avoided by the unwinding cam part.

In the above-mentioned cable winding device, preferably, the rotatable member has a winding-side rotation-permitting section that is engaged with the sliding part and that permits rotation of the rotatable member and the lever as one body in the winding direction, and the base member has a winding cam part that releases or avoids engagement of the sliding part with the winding-side rotation-permitting section so as to permit the lever to be rotated in the winding direction relative to the rotatable member.

The base member has the winding cam part that releases or avoids engagement of the sliding part with the winding-side rotation-permitting section so as to permit the lever to be rotated in the winding direction relative to the rotatable member, whereby the engagement of the sliding part with the winding-side rotation-permitting section is released or avoided by the winding cam part.

In the above-mentioned cable winding device, preferably, a cover case that covers at least part of the cable is provided, and the cover case is integrally formed with the control rib.

The cover case that covers at least part of the cable is provided, and the cover case is integrally formed with the control rib, whereby the position of the control part is controlled by the control rib integrally formed with the cover case.

In the above-mentioned cable winding device, preferably, the cover case that covers at least part of the cable is provided, and the cover case is integrally formed with the restraint rib.

The cover case that covers at least part of the cable is provided, and the cover case is integrally formed with the restraint rib, whereby the rotation of the rotatable member is restrained by the restraint rib integrally formed with the cover case.

In the above-mentioned cable winding device, preferably, the control rib and the restraint rib are provided as reinforcement ribs configured to reinforce the cover case.

The control rib and the restraint rib are provided as the reinforcement ribs configured to reinforce the cover case, whereby the cover case is reinforced by the restraint rib and the control rib.

In the above-mentioned cable winding device, preferably, the winding reel has a first winding tube section and a second winding tube section that are located coaxially with each other, and different parts of the cable can be wound respectively around the first winding tube section and the second winding tube section.

The winding reel has the first winding tube section and the second winding tube section that are located coaxially with each other, and the different parts of the cable can be wound respectively around the first winding tube section and the second winding tube section, whereby a winding radius of the cable is reduced.

In the above-mentioned cable winding device, preferably, the different parts of the cable can be simultaneously wound and unwound.

The different parts of the cable can be simultaneously wound and unwound, whereby the winding and unwinding of the different parts of the cable are simultaneously performed.

According to the embodiment of the present technology, a cable winding device includes: a base member disposed in a fixed state; a winding reel that is connected to part of a cable and that can be rotated relative to the base member in a cable winding direction and a cable unwinding direction reverse to the cable winding direction; a lever supported on the winding reel and rotated together with the winding reel relative to the base member; a biasing member biasing the winding reel in the winding direction; a rotatable member that is disposed to face the base member, that can be rotated relative to the base member with a fulcrum axis as a fulcrum, the fulcrum axis being located coaxially with a rotational axis of the winding reel, and that has a control part operative to control winding of the cable; and a control rib located on a locus of rotation of the rotatable member. The winding of the cable is controlled according to the position of the control part relative to the control rib.

Thus, winding of the cable is controlled through controlling the position of the control part, without using a spherical element functioning as a bearing. Therefore, reliability of operation can be secured while promising a simplified mechanism and enhanced durability.

According to the embodiment of the present technology, regions on circumferentially opposite sides of the control rib are respectively a first region and a second region, and the rotatable member is rotated and the control part is moved from the first region into the second region when the cable is unwound and the winding reel is rotated in the unwinding direction. The control part is moved from the second region into the first region when the rotatable member is rotated in the winding direction by a biasing force of the biasing member in a condition where the control part has been moved from the first region into the second region.

Therefore, the position of the control part is assuredly changed according to the operation on the cable, which promises enhanced reliability during the operation on the cable.

According to the embodiment of the present technology, the base member has a rotation-restraining part, and the lever has a to-be-stopped part. When the rotatable member is rotated in the winding direction and the control part is moved from the second region into the first region, the to-be-stopped part is engaged with the rotation-restraining part, whereby the winding reel is restrained from being rotated in the winding direction.

Therefore, rotation of the winding reel is securely restrained by the movement of the control part of the rotatable member, which promises enhanced reliability of operation when unwinding of the cable is finished.

According to the embodiment of the present technology, in a condition where the control part is located in the first region, the winding reel is rotated in the winding direction by the biasing force of the biasing member, whereby the cable is wound.

Therefore, winding of the cable is securely performed according to the position of the control part of the rotatable member, which ensures enhanced reliability of operation during winding of the cable.

According to the embodiment of the present technology, the rotatable member has a to-be-restrained section, and a restraint rib that can be engaged with the to-be-restrained section and that restrains rotation of the rotatable member when in engagement with the to-be-restrained section is provided between the first region and the second region. The to-be-restrained section is engaged with the restraint rib and the control part is held in the first region when the rotatable member is rotated during winding of the cable.

Therefore, the control part of the rotatable member is held in the first region without being moved from the first region into the second region, whereby the winding of the cable can be performed assuredly.

According to the embodiment of the present technology, the restraint rib is formed in a shape extending in a radial direction of the rotatable member, and the restraint rib is located over a range from an innermost circumference to an outermost circumference of the rotatable member.

Therefore, the to-be-restrained part is assuredly engaged with the restraint rib, and reliability of the operation of winding the cable can be enhanced.

According to the embodiment of the present technology, the control rib and the restraint rib are located on opposite sides of the rotational axis.

Therefore, setting of each operation is easy to carry out, and operations on the cable can be controlled assuredly and easily.

According to the embodiment of the present technology, the lever has a sliding part, and an outer circumferential surface of the rotatable member is an active surface to be slidably engaged with the sliding part of the lever. The active surface has an engagement part that is smaller than the outermost circumference of the rotatable member in radial distance from the fulcrum axis, and the to-be-stopped part is engaged with the rotation-restraining part through engagement of the sliding part of the lever with the engagement part.

Therefore, the to-be-stopped part of the lever is assuredly engaged with the rotation-restraining part of the base member, whereby setting of operation upon finish of unwinding of the cable can be performed easily and securely.

According to the embodiment of the present technology, the lever is turnably supported on the winding reel, and a biasing spring configured to bias the lever in a direction for the sliding part to be pressed against the active surface is provided.

Therefore, the sliding part of the lever is assuredly let slide on the active surface, which promises enhanced reliability of each operation.

According to the embodiment of the present technology, the rotatable member has a displaceable section that includes the control part and that is elastically deformable in directions for coming closer to and away from the control rib. The displaceable section is elastically deformed when the rotatable member is rotated, whereby the control part is let slide on the control rib and is moved on both sides of the control rib.

Therefore, the movement of the control part of the rotatable member is effected simply through the elastic deformation of the displaceable section. This ensures that enhanced reliability of operation can be secured while promising a simplified mechanism.

According to the embodiment of the present technology, the rotatable member has the displaceable section that includes the control part and that is elastically deformable in the directions for coming closer to and away from the control rib. The displaceable section is elastically deformed when the rotatable member is rotated, whereby the control part is let slide on the control rib and is moved on both sides of the control rib. Part of the lever is disposed between the base member and the rotatable member, and when the control part is located in the first region and the lever is located between the base member and the displaceable section of the rotatable member, elastic deformation of the displaceable section is restrained by the lever and the control part is held in the first region.

Therefore, the need for any member for exclusive use to restrain elastic deformation of the displaceable section of the rotatable member is eliminated, whereby each operation on the cable can be performed with a simple mechanism, while ensuring a reduction in the number of component parts.

According to the embodiment of the present technology, the rotatable member has an unwinding-side rotation-permitting section that is engaged with the sliding part and that permits rotation of the rotatable member and the lever as one body in the unwinding direction, and the base member has an unwinding cam part that releases or avoids engagement of the sliding part with the unwinding-side rotation-permitting section so as to permit the lever to be rotated in the unwinding direction relative to the rotatable member.

Therefore, unwinding of the cable can be assuredly carried out with a simple structure.

According to the embodiment of the present technology, the rotatable member has a winding-side rotation-permitting section that is engaged with the sliding part and that permits rotation of the rotatable member and the lever as one body in the winding direction, and the base member has a winding cam part that releases or avoids engagement of the sliding part with the winding-side rotation-permitting section so as to permit the lever to be rotated in the winding direction relative to the rotatable member.

Therefore, winding of the cable can be reliably performed with a simple structure.

According to the embodiment of the present technology, a cover case that covers at least part of the cable is provided, and the cover case is integrally formed with the control rib.

Therefore, the number of component parts is reduced, and a reduction in the manufacturing cost of the cable winding device can be achieved.

According to the embodiment of the present technology, the cover case that covers at least part of the cable is provided, and the cover case is integrally formed with the restraint rib.

Therefore, the number of component parts is reduced, which realizes a reduction in the manufacturing cost of the cable winding device.

According to the embodiment of the present technology, the control rib and the restraint rib are provided as reinforcement ribs configured to reinforce the cover case.

Therefore, the cover case is reinforced also by the restraint rib and the control rib, so that rigidity of a top surface section can be enhanced.

According to the embodiment of the present technology, the winding reel has a first winding tube section and a second winding tube section that are located coaxially with each other, and different parts of the cable can be wound respectively around the first winding tube section and the second winding tube section.

Therefore, the winding radius of the cable is reduced, and a reduction in the radial size of the cable winding device can be contrived.

According to the embodiment of the present technology, the different parts of the cable can be simultaneously wound and unwound.

Therefore, the cable can be wound and unwound speedily, and the convenience in use of the cable winding device can be enhanced.

DETAILED DESCRIPTION OF THE PREFERRED EMBODIMENT

Now, a best mode for carrying out the cable winding device according to an embodiment of the present technology will be described below, referring to the attached drawings.

The best mode as follows shows an application of the cable winding device according to the embodiment of the present technology to a cable winding device configured to deal with a cable which is connected between two electronic apparatuses so as to perform data communication and the like therethrough.

It is to be noted here, however, that the range of application of the cable winding device according to the embodiment of the present technology is not limited to the cable winding device configured to deal with a cable which is connected between two electronic apparatuses for the purpose of data communication and the like. The cable winding device according to the embodiment of the present technology is widely applicable to various cable winding devices configured to deal with various cables, such as a power supply cable configured to supply electric power and a transmission cable for transmission of images and/or sounds.

Incidentally, in the cable winding device shown below, an axial direction of a rotational shaft of a winding reel in winding and unwinding a cable is designated as a vertical direction.

It should be noted, however, that directions shown below are merely for convenience of description, and are not restrictive in carrying out the cable winding device according to the embodiment of the present technology.

[Configuration of Cable Winding Device]

First of all, a configuration of the cable winding device will be described (see FIGS. 1 to 9).

Figure 1:
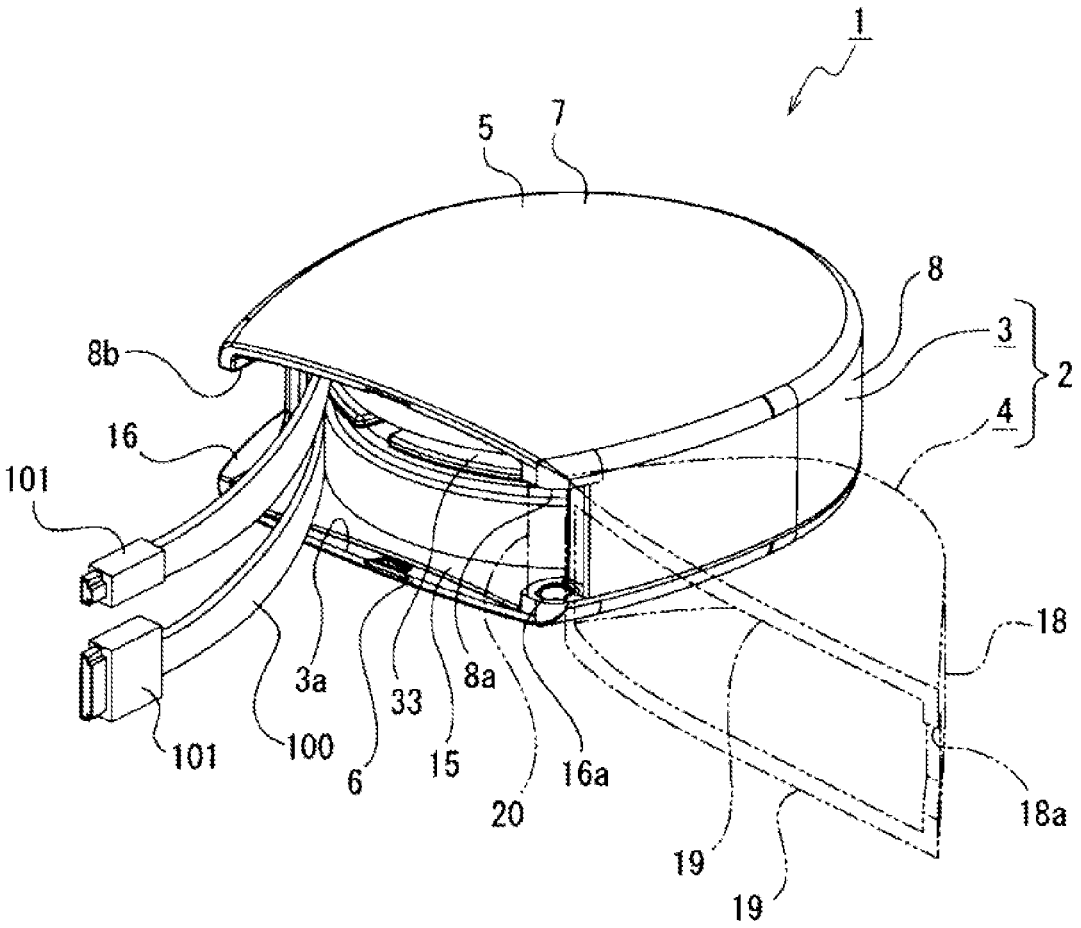
FIG. 1 shows, together with FIGS. 2 to 27, a cable winding device according to an embodiment of the present technology, and it is a perspective view.
Figure 2:
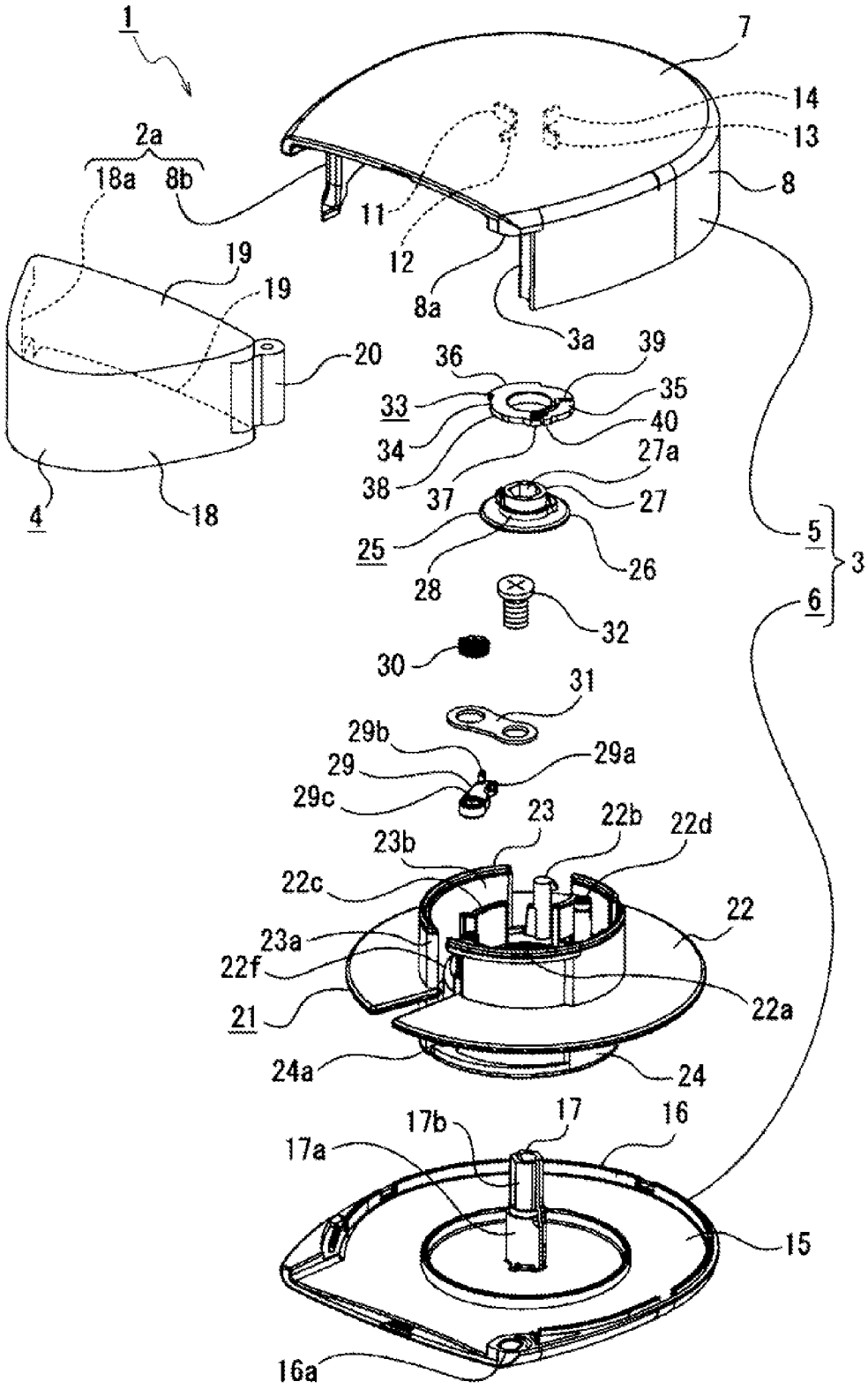
FIG. 2 is an exploded perspective view of the cable winding device.

A cable winding device 1 has a casing 2 which includes a case body 3 and a cap body 4 turnably (openably and closably) supported on the case body 3 (see FIGS. 1 and 2).

The case body 3 has a cover case 5 and a bottom case 6 coupled to each other from upper and lower sides.

Figure 3:
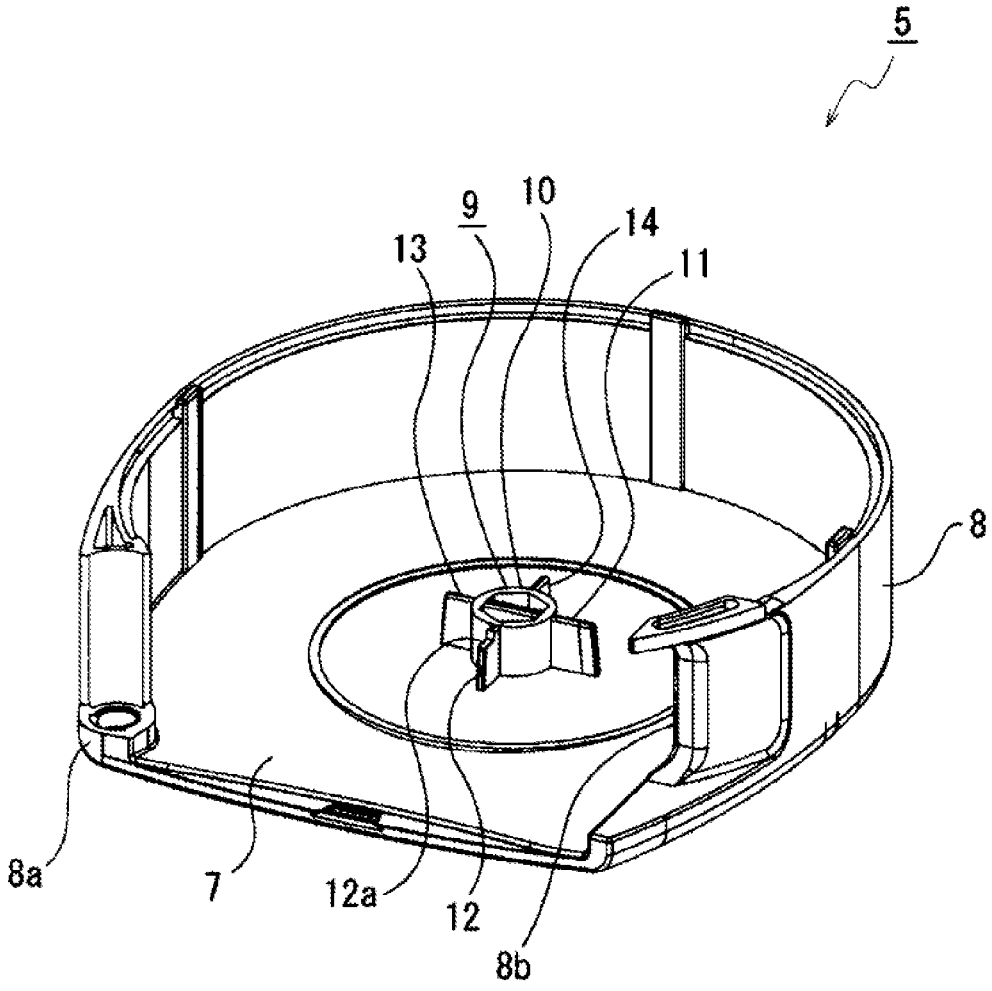
FIG. 3 is an enlarged perspective view of a cover case.

The cover case 5 includes, in an integral form, a top surface section 7 and a circumferential surface section 8 projected downward from most part, exclusive of a part, of an outer circumferential edge of the top surface section 7 (see FIGS. 2 and 3).

Of the outer circumferential edge of the top surface section 7, the part continuous with the circumferential surface section 8 is formed in an outwardly-convexed curved line shape, whereas the part not continuous with the circumferential surface section 8 is formed in a straight line shape.

The circumferential surface section 8 has a support part 8*a* at a circumferential-directionally one end portion thereof. The circumferential surface section 8 has an unwinding cutout 8*b* at a circumferential-directionally other end portion.

The top surface section 7 has, at a lower surface thereof, a rib body 9 projected downward. The rib body 9 includes: a central projection 10 formed in a cylindrical shape; and a restraint rib 11, a first reinforcement rib 12, a control rib 13 and a second reinforcement rib 14 which each protrude in a radial direction from an outer circumferential surface of the central projection 10. The restraint rib 11, the first reinforcement rib 12, the control rib 13 and the second reinforcement rib 14 are arranged in this order, at regular intervals along the circumferential direction.

The restraint rib 11 is greater than the first reinforcement rib 12, the control rib 13 and the second reinforcement rib 14 in length along the protruding direction from the central projection 10.

The first reinforcement rib 12 has a passing cutout 12*a* formed so as to be opened downward and in the protruding direction from the central projection 10.

The restraint rib 11 and the control rib 13 are provided also as reinforcement ribs for enhancing rigidity of the top surface section 7 of the cover case 5, together with the first reinforcement rib 12 and the second reinforcement rib 14.

Therefore, the top surface section 7 of the cover case 5 is reinforced not only with the first reinforcement rib 12 and the second reinforcement rib 14 but also with the restraint rib 11 and the control rib 13. Consequently, the rigidity of the top surface section 7 can be enhanced.

In addition, the restraint rib 11 is formed as one body with the cover case 5. This ensures that the number of component parts is reduced, which promises a reduction in the manufacturing cost of the cable winding device 1.

Furthermore, the control rib 13 is formed as one body with the cover case 5. This ensures a further reduction in the number of component parts and promises a further reduction in the manufacturing cost of the cable winding device 1.

As shown in FIG. 2, the bottom case 6 includes: a base surface section 15 formed in the same shape as the top surface section 7 of the cover case 5; a coupling projection 16 provided at most part, exclusive of a part, of an outer circumferential portion of the base surface section 15; and a support shaft section 17 projected upward from a substantially central portion of the base surface section 15.

The coupling projection 16 is slightly projected upward. The coupling projection 16 has a support part 16*a* at a circumferential-directionally one end portion thereof.

Of the support shaft section 17, a substantially one half portion on the lower side is a rotational support part 17*a* which is substantially circular in sectional shape of an outer circumferential surface thereof. Of the support shaft section 17, a substantially one half portion on the upper side is a fixational support part 17*b* which is, for example, substantially hexagonal in sectional shape of an outer circumferential surface thereof.

The bottom case 6 is coupled to the cover case 5, with the coupling projection 16 abutted on a lower end portion of the circumferential surface section 8. In a condition where the cover case 5 and the bottom case 6 are coupled with each other to form the case body 3, the case body 3 has an unwinding port 3*a* through which the inside and the outside of the case body 3 communicate with each other.

The cap body 4 includes: a circumferential wall section 18 having a curved surface shape; and side wall sections 19, 19 protruding in a same horizontal direction from upper and lower edges of the circumferential wall section 18 (see FIGS. 1 and 2). The circumferential wall section 18 has an unwinding cutout 18*a* formed at an end portion thereof.

The cap body 4 is turnably supported on the case body 3 through a hinge member 20. The hinge member 20 is turnably supported at one end portion thereof on the support parts 8*a* and 16*a* of the case body 3, and is turnably supported at the other end portion thereof on the other end portion of the cap body 4, thereby connecting the case body 3 and the cap body 4 to each other.

The cap body 4 is turned relative to the case body 3 through the hinge member 20, so as to open and close the unwinding port 3*a* of the case body 3. In a condition where the unwinding port 3*a* is closed with the cap body 4, the unwinding cutout 8*b* of the case body 3 and the unwinding cutout 18*a* of the cap body 4 form an insertion-and-passage port 2*a* in the casing 2.

In the cable winding device 1, winding and unwinding of a cable to be described later can be performed through the unwinding port 3*a* in a condition where the cap body 4 is so situated as to open the unwinding port 3*a*. In the condition where the unwinding port 3*a* is closed with the cap body 4 and the insertion-and-passage port 2*a* is formed, winding and unwinding of the cable can be performed through the insertion-and-passage port 2*a*.

Inside the case body 3 is disposed a winding reel 21. The winding reel 21 is rotatably supported on the rotational support part 17*a* of the support shaft section 17 of the bottom case 6. Therefore, a center axis of the support shaft section 17 is a rotational axis 21*a* of the winding reel 21.

Figure 4:
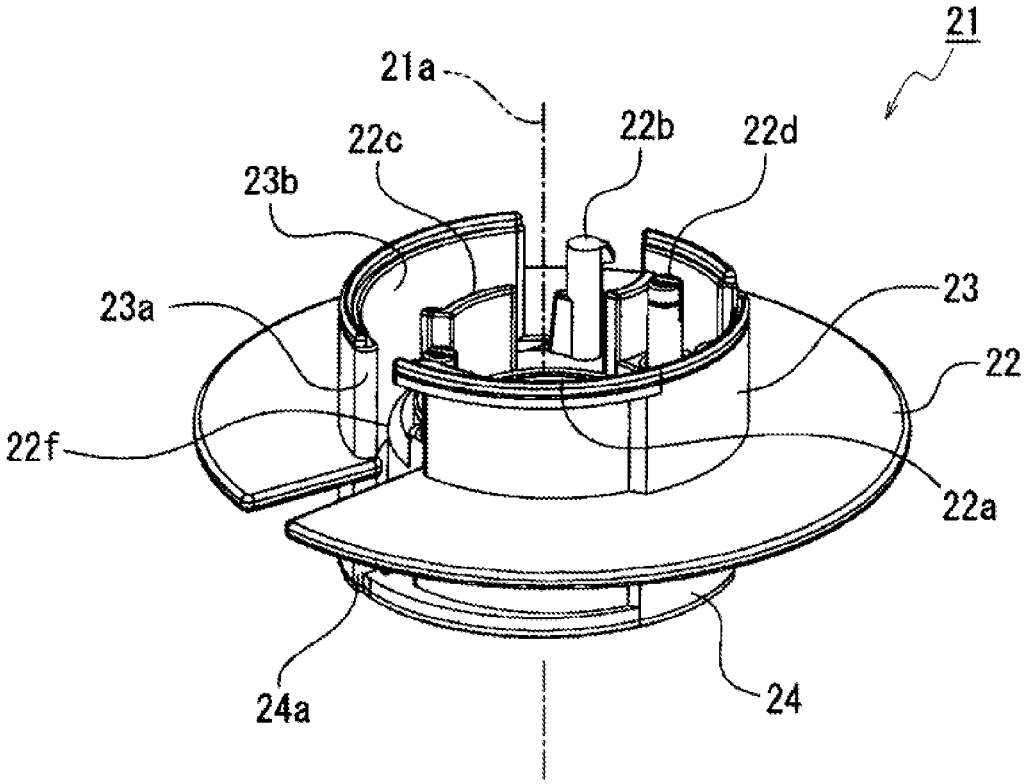
FIG. 4 is an enlarged perspective view of a winding reel.

As shown in FIGS. 2 and 4, the winding reel 21 includes: a reel base 22 having a substantially circular disk shape with major surfaces oriented upward and downward, respectively; a first winding tube section 23 projected upward from a radial-directionally substantially middle portion of the reel base 22; and a second winding tube section 24 projected downward from the radial-directionally substantially middle portion of the reel base 22.

The reel base 22 has a shaft insertion-and-passage hole 22*a* formed in a central portion thereof.

The first winding tube section 23 is formed in a substantially cylindrical shape, and has a communication slit 23*a* extending vertically. The inside space of the first winding tube section 23 is formed as a mechanism disposing section 23*b*.

The mechanism disposing section 23*b* has a fixational shaft 22*b*, a fixational projected wall 22*c*, a lever support shaft 22*d* and a screwing boss 22*e* which are each projected upward from the reel base 22. The reel base 22 has an arcuate communication hole 22*f* formed for communication with the inside of the second winding tube section 24, at the immediate inside of the first winding tube section 23 in the mechanism disposing section 23*b*. The fixational shaft 22*b* is formed in a substantially cylindrical shape, the fixational projected wall 22*c* is formed in a substantially arcuate shape extending along the circumferential direction, and the lever support shaft 22*d* is formed in a substantially cylindrical shape.

The second winding tube section 24 is formed in a substantially cylindrical shape, and has a communication slit 24*a* which extends vertically and which communicates with the communication hole 22*f* formed in the reel base 22.

Inside of the second winding tube section 24 is disposed a biasing member, which is not shown. The biasing member is, for example, a spiral spring. By the biasing member, the winding reel 21 is biased in a direction for winding up a cable 100, for example, in a clockwise direction as viewed in plan view.

Figure 5:
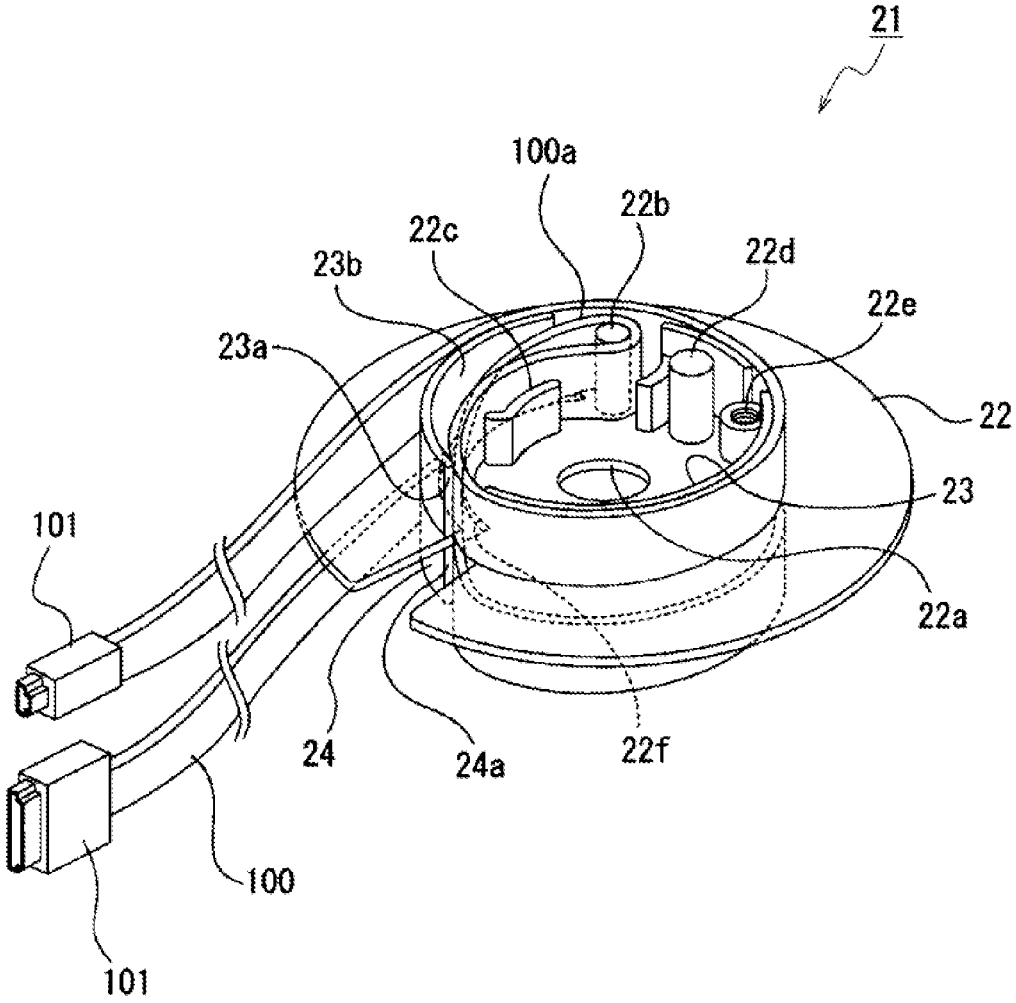
FIG. 5 is an enlarged perspective view of the winding reel, with a cable attached thereto.
Figure 6:
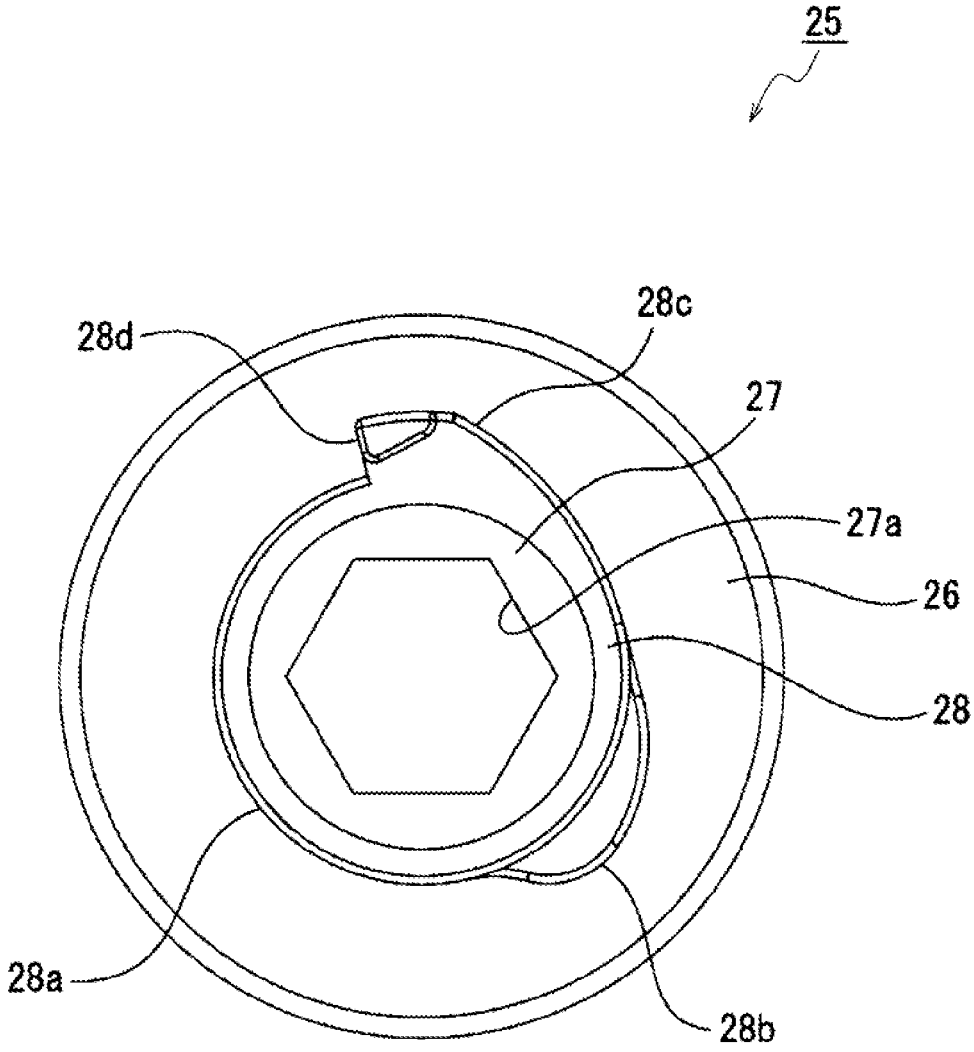
FIG. 6 is an enlarged plan view of a base member.

The cable 100 is wound around the winding reel 21 (see FIG. 5). As the cable 100, for example, an HDMI (high-definition multimedia interface) cable is used. In general, an HDMI cable is greater than a headphone cable or the like in thickness and weight. The cable 100 has, for example, connectors 101, 101 at both end portions thereof. The cable 100 is fixed by being press fitted between the fixational projected wall 22*c* and the first winding tube section 23 in a state where an intermediate portion 100*a* of the cable 100 is wound around the fixational shaft 22*b*. Of the cable 100, a part on one side of the intermediate portion 100*a* can be wound around the first winding tube section 23 by being passed through the communication slit 23*a*, and a part on the other side of the intermediate portion 100*a* can be wound around the second winding tube section 24 by being passed through the communication hole 22*f* and the communication slit 24*a*.

In the cable winding device 1 configured as above, different portions of the cable 100 are respectively wound around the first winding tube section 23 and the second winding tube section 24 located coaxially on the winding reel 21. This ensures that the winding radius of the cable 100 is made smaller, and promises a reduction in the radial size of the cable winding device 1.

The support shaft section 17 of the bottom case 6 is inserted into and passed through the shaft insertion-and-passage hole 22*a* in the winding reel 21, from the lower side. In a condition where the support shaft section 17 is passed through the shaft insertion-and-passage hole 22*a* in the winding reel 21, a base member 25 is mounted to the fixational support part 17*b* in a state of being fixed circumferential-directionally (see FIG. 2).

The base member 25 includes: a circular disk-shaped base section 26; a tubular section 27 projected upward from a radial-directionally substantially middle portion of the base section 26; and a sliding cam section 28 protruding outward at a lower end portion of the tubular section 27.

A hole on the inside of the tubular section 27 is a hexagonal fitting hole 27*a*.

An outer circumferential surface of the sliding cam section 28 includes: an arcuate non-active part 28*a*; a winding cam part 28*b* which is continuous with one end of the non-active part 28*a* and formed in an outwardly convexed curved surface shape; an unwinding cam part 28*c* which is continuous with one end of the winding cam part 28*b* and inclined so as to be displaced outward as one goes away from the winding cam part 28*b*; and a rotation-restraining part 28*d* interconnecting one end of the unwinding cam part 28*c* and the other end of the non-active part 28*a*.

The base member 25 is fixed to the support shaft section 17 by fitting the fixational support part 17*b* into the fitting hole 27*a*.

A lever 29 formed to be long in one direction is turnably supported on the lever support shaft 22*d* provided on the reel base 22 of the winding reel 21 (se FIG. 2). The lever 29 has, at a longitudinal-directional one end portion thereof, a to-be-stopped part 29*a* projected sideways and a sliding part 29*b* projected upward. The lever 29 has, at a longitudinal-directional other end portion thereof, a rotational support hole 29*c* piercing therethrough in the vertical direction.

With the lever support shaft 22*d* inserted in the rotational support hole 29*c* of the lever 29, the lever 29 can be turned, with the lever support shaft 22*d* as a fulcrum. In a condition where the lever 29 is supported on the lever support shaft 22*d*, part of the lever 29 is located on the upper side of the base member 25.

The lever 29 is biased by a biasing spring 30 in a direction for a longitudinal-directional one end portion thereof to be brought closer to the support shaft section 17. The biasing spring 30 is, for example, a torsion coil spring, and is supported by the lever support shaft 22*d*.

One end portion of a presser member 31 is attached by an attaching screw 32 to the screwing boss 22*e* provided on the reel base 22 of the winding reel 21, and the other end portion of the presser member 31 is mounted onto the lever support shaft 22*d* from above the lever 29, whereby the lever is prevented by the presser member 31 from slipping off from the lever support shaft 22*d*.

On the tubular section 27 of the base member 25 is rotatably supported a rotatable member 33 (see FIG. 2). Therefore, a fulcrum axis 33*a* as a fulcrum for rotation of the rotatable member 33 is coaxial with the rotational axis 21*a* of the winding reel 21.

Figure 7:
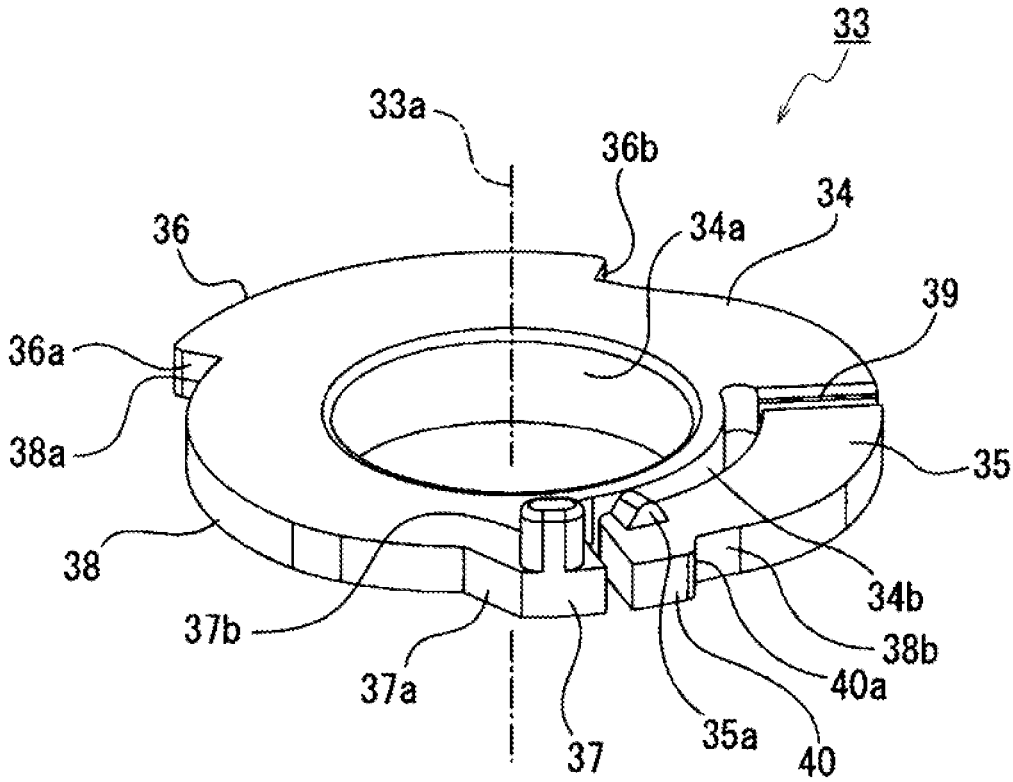
FIG. 7 is an enlarged perspective view of a rotatable member.
Figure 8:
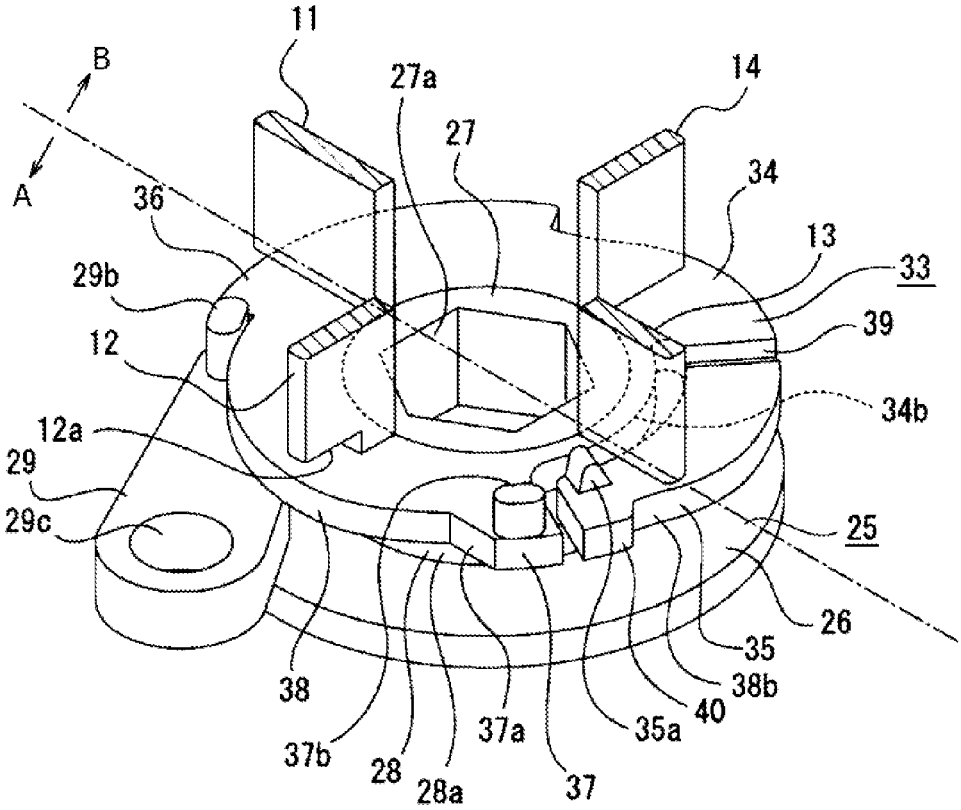
FIG. 8 is an enlarged perspective view showing the base member, a lever, the rotatable member and ribs.
Figure 9:
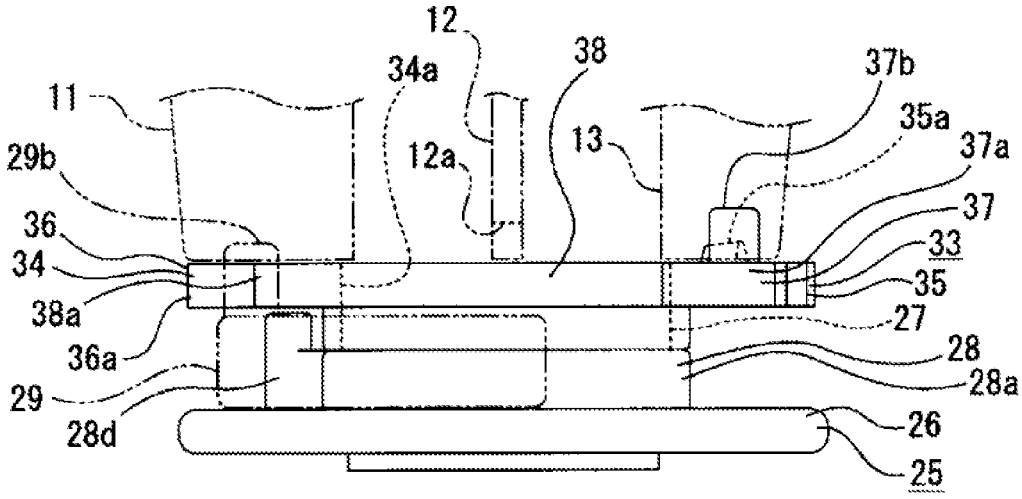
FIG. 9 is a schematic enlarged side view showing the base member, the lever, the rotatable member and the ribs.

The rotatable member 33 is formed in a substantially circular annular shape, and includes an annular section 34 and a displaceable section 35 which can be elastically deformed in relation to the annular section 34 (see FIG. 7).

The annular section 34 has a to-be-supported hole 34*a* in which the tubular section 27 is to be inserted. The annular section 34 has a first protruding part 36 and a second protruding part 37 which are each protruding outward (in the radial direction) and are spaced from each other along the circumferential direction.

The first protruding part 36 is circumferentially longer than the second protruding part 37. Of the first protruding part 36, a circumferential-directional one end surface is a winding-side rotation-permitting section 36*a*, and a circumferential-directional other end surface is an unwinding-side rotation-permitting section 36*b*.

Of the second protruding part 37, a circumferential-directional one end surface is a first engagement surface 37*a*. At an outer end portion of the second protruding part 37 is provided a to-be-restrained section 37*b*, which is projected upward.

The annular section 34 has, in the vicinity of the second protruding part 37, a small-width part 34*b* which is smaller than other part in radial width. The small-width part 34*b* is located on the side of the inner circumference of the rotatable member 33.

The displaceable section 35 is located on the outer side of the small-width part 34*b* in a state of extending along the circumferential direction. The displaceable section 35 is continuous with the annular section 34 through a hinge section 39. The displaceable section 35 has, at a tip portion thereof, a third protruding part 40 which is protruding outward (in the radial direction). A circumferential-directional one end surface of the third protruding part 40 is a second engagement surface 40*a*.

The displaceable section 35 has, at a tip portion thereof, a control part 35*a* which is projected upward. The control part 35*a* is formed in a mountain-like shape having two inclined surfaces aligned along the circumferential direction.

An outer circumferential surface of the rotatable member 33 is an active surface 38 on which the sliding part 29*b* of the lever 29 is let slide. Of the active surface 38, an end portion continuous with an inner end of the winding-side rotation-permitting section 36*a* is a first engagement part 38*a*, while an end portion continuous with an inner end of the second engagement surface 40*a* is a second engagement part 38*b*. The first engagement part 38*a* is located on the inner side in the radial direction of the rotatable member 33, as compared with the second engagement part 38*b*.

In a condition where the rotatable member 33 is rotatably supported on the tubular section 27 of the base member 25, part of the lever 29 is located between the base member 25 and the rotatable member 33 (see FIGS. 8 and 9), and the sliding part 29*b* of the lever 29 is pressed against the active surface 38 of the rotatable member 33 by a biasing force of the biasing spring 30.

The restraint rib 11, the first reinforcement rib 12, the control rib 13 and the second reinforcement rib 14 provided on the cover case 5 have their lower surfaces located in proximity to an upper surface of the rotatable member 33, and they are located on a locus of rotation of the rotatable member 33. In a condition where the restraint rib 11, the first reinforcement rib 12, the control rib 13 and the second reinforcement rib 14 are located in proximity to the rotatable member 33, regions on opposite sides of a line interconnecting the restraint rib 11 and the control rib 13, with respect to the locus of rotation of the rotatable member 33, are respectively a first region A and a second region B (see FIG. 8). The first region A is a region on one side on which the first reinforcement rib 12 is located, while the second region B is a region on the other side on which the second reinforcement rib 14 is located.

[Operation of Cable Winding Device]

Now, operations (operation modes) of the cable winding device 1 on the cable 100 will be described below (see FIGS. 10 to 27). Incidentally, in describing the operations below, the winding direction for the cable 100 is indicated as R1 direction which is the clockwise direction as viewed in plan view, and the unwinding direction of the cable 100 is indicated as R2 direction which is the counterclockwise direction as viewed in plan view.

Each of the operation modes described below is set according to the position of the control part 35*a* provided at the displaceable section 35 of the rotatable member 33. A stop mode, an unwinding mode and a winding mode are set as the operation modes. In the stop mode, the control part 35*a* is moved from the second region B into the first region A; in the unwinding mode, the control part 35*a* is moved from the first region A into the second region B; and in the winding mode, the control part 35*a* is located in the first region A.

In the cable winding device 1, the restraint rib 11 and the control rib 13 are located on the exactly opposite sides of the rotational axis 21*a* of the winding reel 21 (with an angular interval around the rotational axis 21*a* of 180° therebetween); thus, the first region A and the second region B are equal in size.

Therefore, each of the operation modes can be set easily, and operation control on the cable 100 can be performed assuredly and easily.

It is to be noted, however, that the positions of the restraint rib 11 and the control rib 13 may be shifted from the above-mentioned positions so that the first region A and the second region B are different in size.

<Stop Mode>

Figure 10:
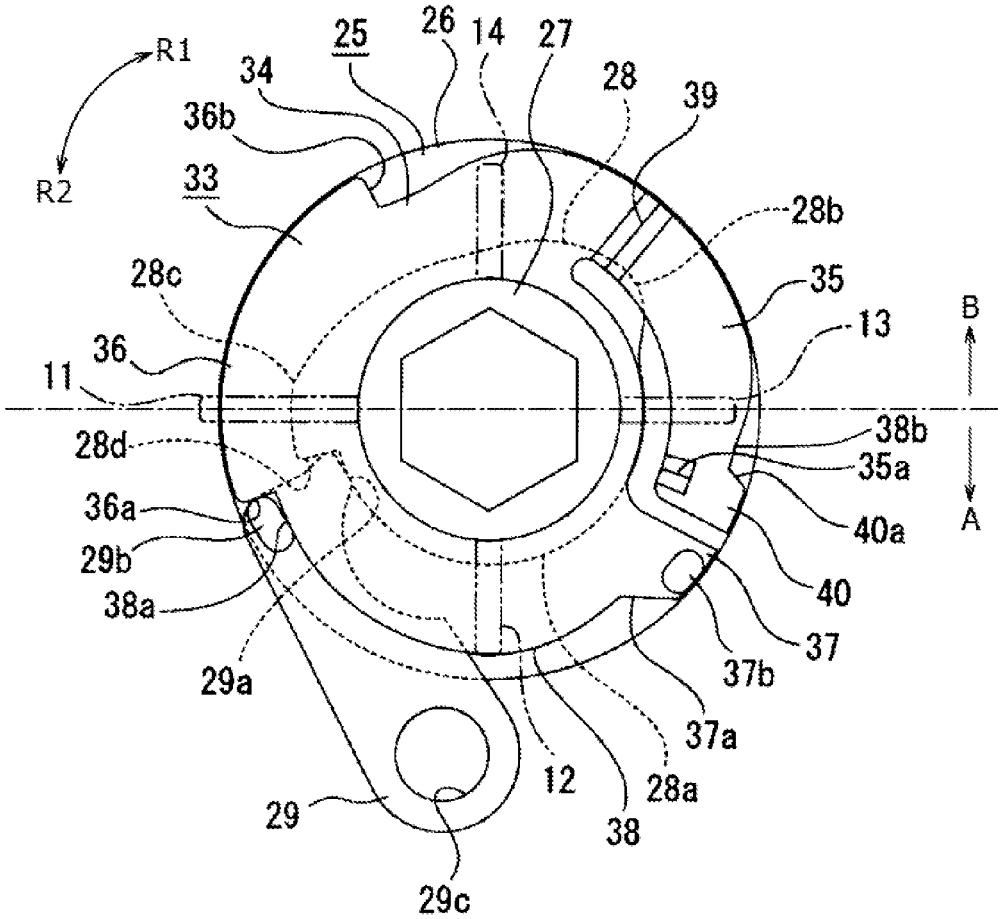
FIG. 10 illustrates, together with FIGS. 11 to 27, operation of the cable winding device, and it is an enlarged plan view showing a state in which winding of the cable is restrained.

First, the stop mode will be described (see FIG. 10). The stop mode is a mode in which winding of the cable 100 is restrained.

In the stop mode, the control part 35*a* provided on the displaceable section 35 of the rotatable member 33 is located between the first reinforcement rib 12 and the control rib 13 in the first region A.

The winding reel 21 is biased in the R1 direction by the biasing member (spiral spring) together with the lever 29, and the lever 29 is biased by the biasing spring 30 in a direction (inward direction) for its sliding part 29*b* to be pressed against the active surface 38 of the rotatable member 33. The sliding part 29*b* of the lever 29 is engaged with the winding-side rotation-permitting section 36*a* of the first protruding part 36 and the first engagement part 38*a* of the active surface 38 of the rotatable member 33, and the to-be-stopped part 29*a* is engaged with the rotation-restraining part 28*d* of the base member 25.

Therefore, rotation of the winding reel 21 and the lever 29 in the R1 direction is restrained, and winding of the cable 100 is restrained.

<Unwinding Mode>

Now, the unwinding mode will be described below (see FIGS. 11 to 18). The unwinding mode is a mode in which the cable 100 is unwound from the inside of the casing 2.

Figure 11:
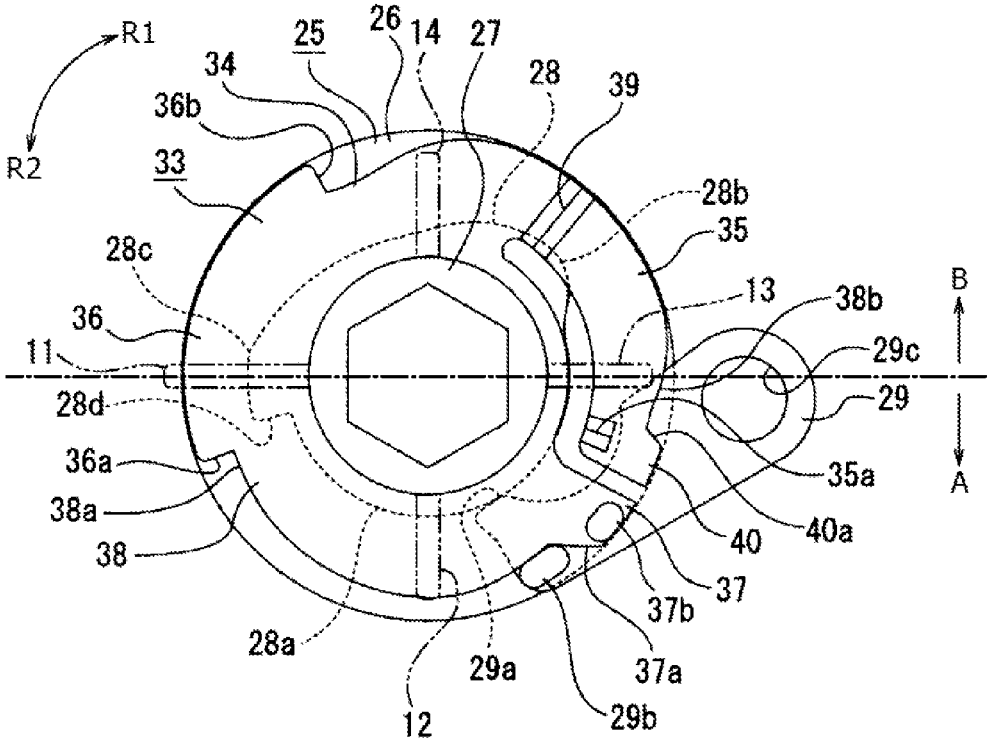
FIG. 11 is an enlarged plan view showing a state immediately after the start of unwinding of the cable.
Figure 12:
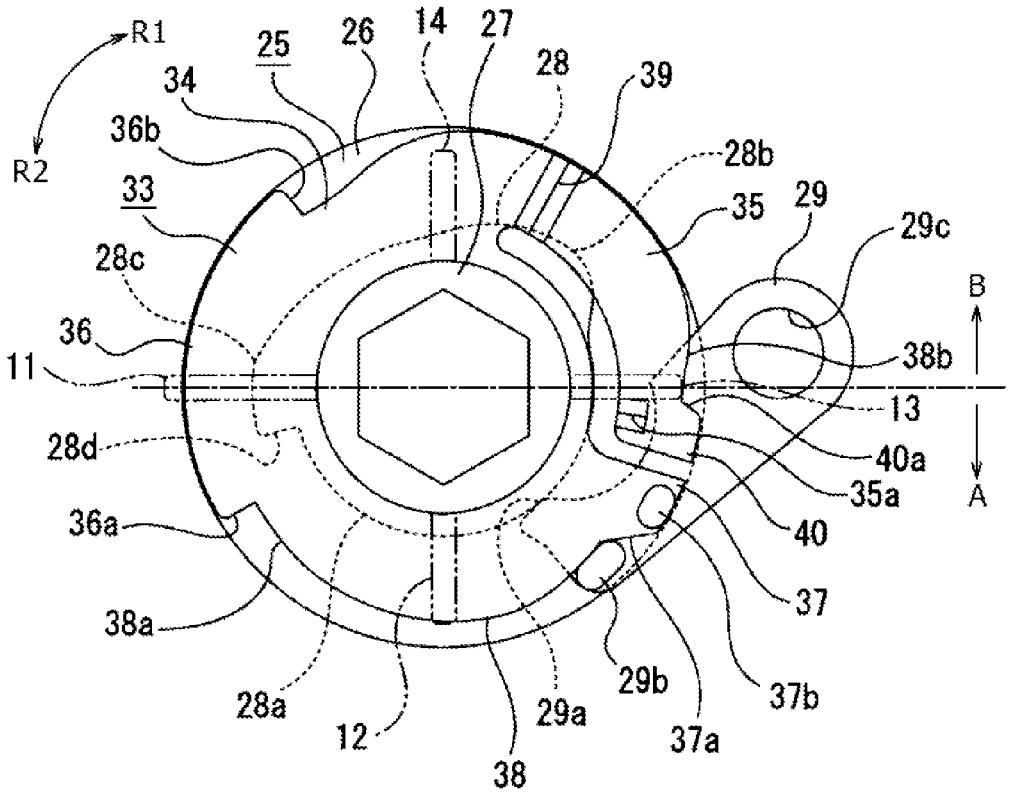
FIG. 12 is an enlarged plan view showing a state in which the cable is unwound subsequently to FIG. 11 and the rotatable member is rotated attendant on the rotation of the winding reel and the lever.

In the unwinding mode, the winding reel 21 and the lever 29 are rotated in the R2 direction as the cable 100 is unwound (see FIG. 11). In this case, of the cable 100, the two parts on the opposite sides of the intermediate portion 100*a* can be simultaneously unwound. Accordingly, unwinding of the cable 100 can be carried out speedily, which promises enhanced convenience in use of the cable winding device 1.

When the winding reel 21 and the lever 29 are rotated in the R2 direction, the sliding part 29*b* is engaged with the first engagement surface 37*a* of the second protruding part 37.

With the cable 100 unwound further, the rotatable member 33 is gradually rotated in the R2 direction as the lever 29 is rotated (see FIG. 12), since the sliding part 29*b* is in engagement with the first engagement surface 37*a*. In this case, since part of the lever 29 is located on the lower side of the displaceable section 35 of the rotatable member 33, the displaceable section 35 is not in an elastically deformable state. The rotatable member 33 is restrained from being rotated in the R2 direction, due to the contact of the control part 35*a* with the control rib 13.

Figure 13:
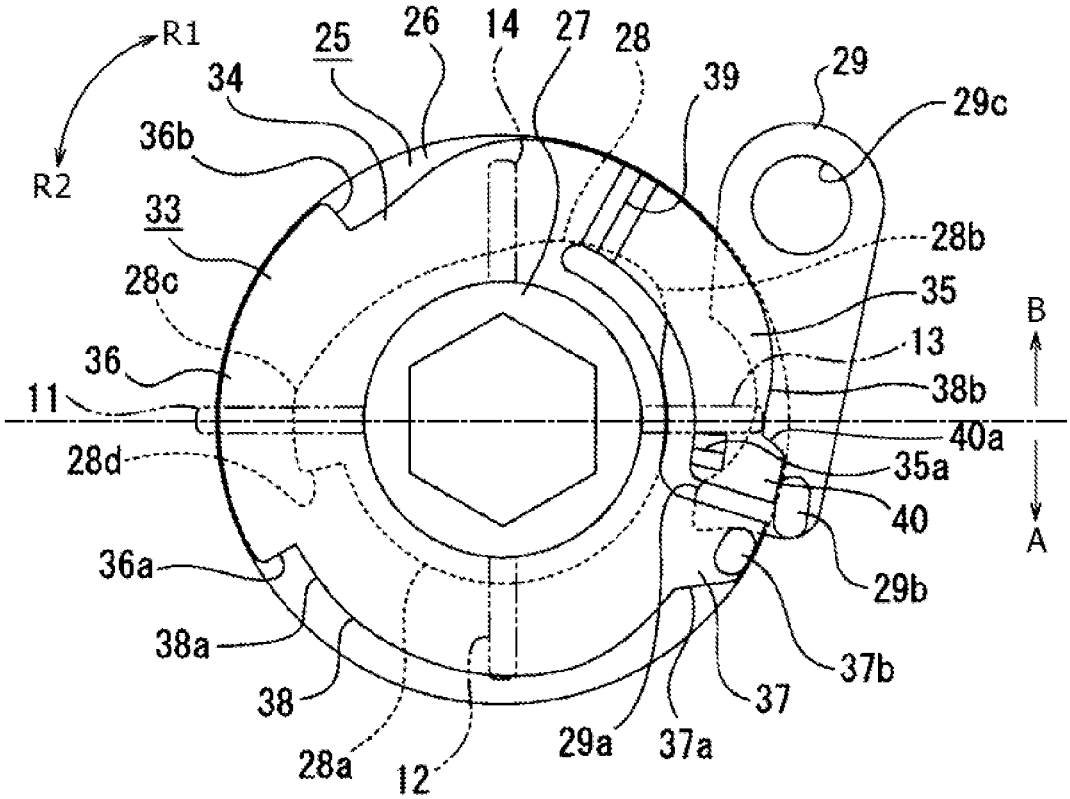
FIG. 13 is an enlarged plan view showing a state in which the cable is unwound subsequently to FIG. 12 and the winding reel and the lever are further rotated.

The cable 100 is further unwound, and the winding reel 21 and the lever 29 are further rotated in the R2 direction (see FIG. 13). The sliding part 29*b* of the lever 29 rides onto the third protruding part 40 from the second protruding part 37.

Figure 14:
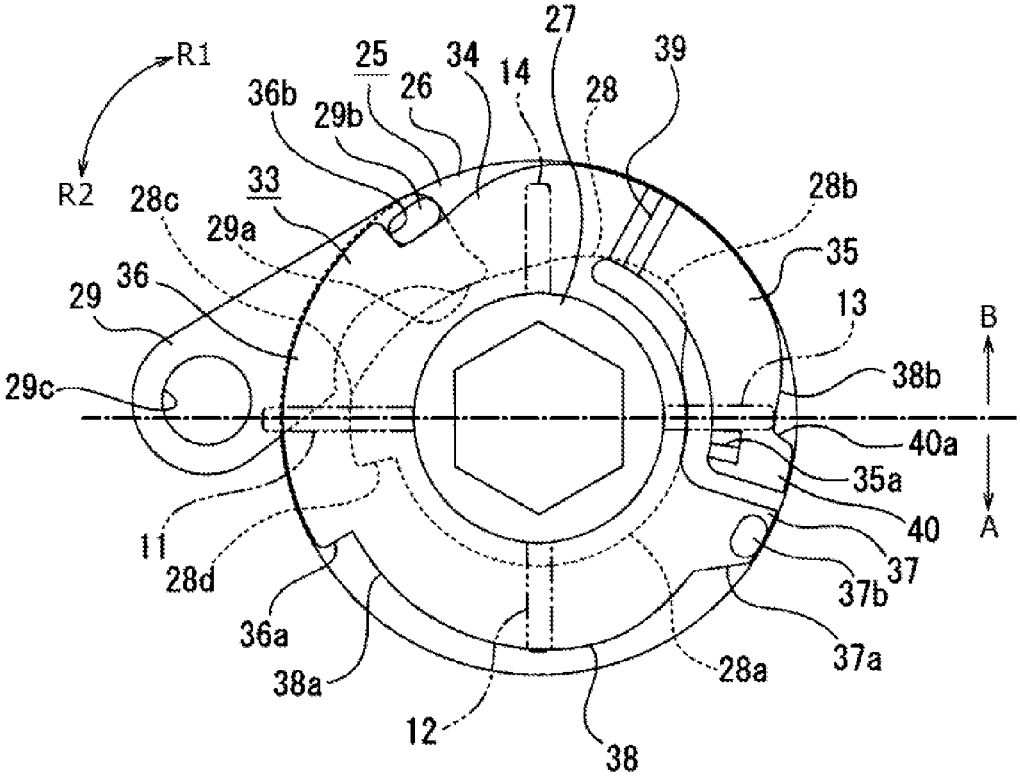
FIG. 14 is an enlarged plan view showing a state in which the cable is unwound subsequently to FIG. 13, the winding reel and the lever are further rotated, and a sliding part of the lever is engaged with an unwinding-side rotation permitting section of the rotatable member.

When the cable 100 is unwound further more, the winding reel 21 and the lever 29 are further rotated in the R2 direction, and the sliding part 29*b* of the lever 29 is engaged with the unwinding-side rotation-permitting section 36*b* of the first protruding part 36 (see FIG. 14).

Figure 15:
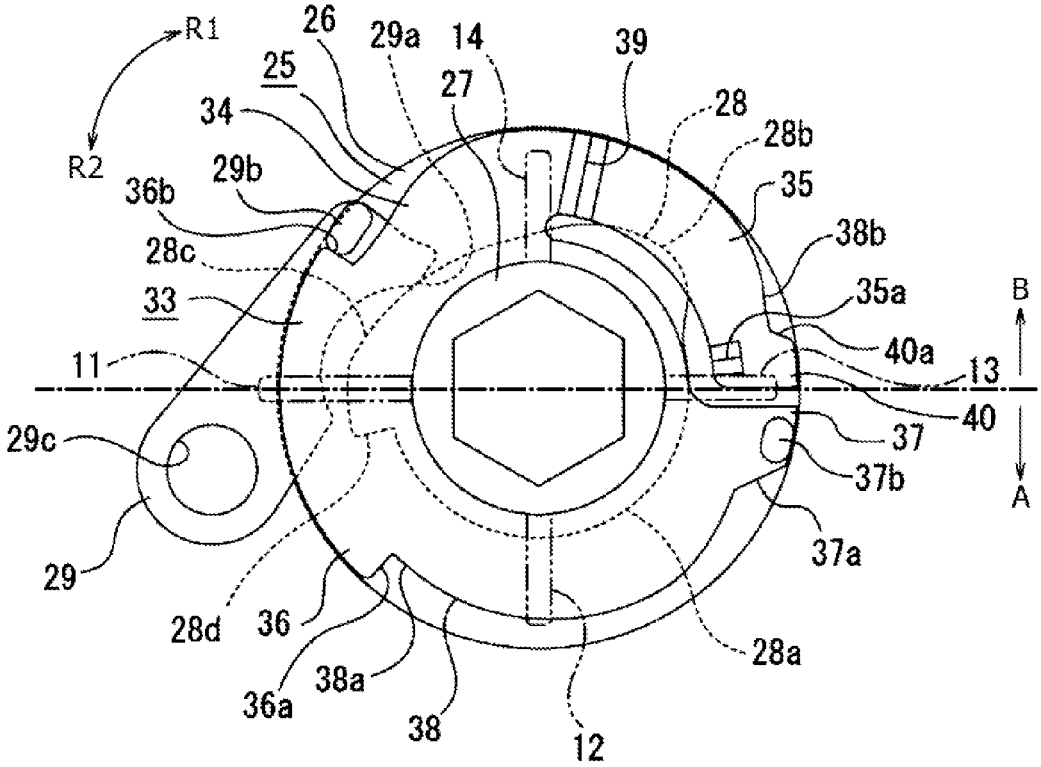
FIG. 15 is an enlarged plan view showing a state in which the cable is unwound subsequently to FIG. 14, and the rotatable member is being rotated attendant on the rotation of the winding reel and the lever.

As the cable 100 continues being unwound, the to-be-stopped part 29*a* of the lever 29 is let slide on the unwinding cam part 28*c* formed on the sliding cam section 28 of the base member 25, and the lever 29 is gradually turned outward against the biasing force of the biasing spring 30 (see FIG. 15). In this case, since the lever 29 is not located on the lower side of the displaceable section 35, the rotatable member 33 is rotated in the R2 direction as the lever 29 is rotated, the displaceable section 35 is elastically deformed, and the control part 35*a* is let slide on a lower edge of the control rib 13, to be located into the second region B.

Figure 16:
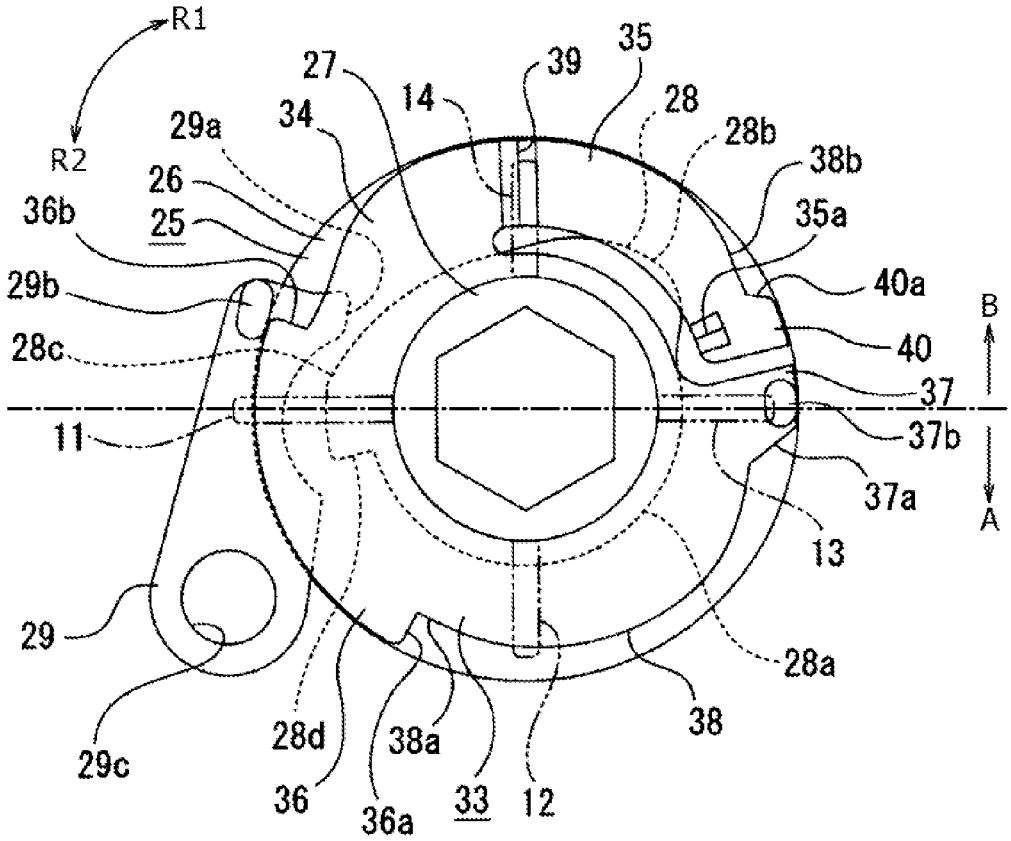
FIG. 16 is an enlarged plan view showing a state in which the cable is unwound subsequently to FIG. 15, the winding reel and the lever are rotated, and the sliding part of the lever is disengaged from the unwinding-side rotation permitting section of the rotatable member.

As the cable 100 is further unwound, the sliding of the to-be-stopped part 29*a* on the unwinding cam part 28*c* causes the lever 29 to be turned outward, the sliding part 29*b* is disengaged from the unwinding-side rotation-permitting section 36*b*, and the sliding part 29*b* rides onto the first protruding part 36 (see FIG. 16). When the sliding part 29*b* thus rides onto the first protruding part 36, the rotation of the rotatable member 33 attendant on the rotation of the lever 29 is stopped. In this instance, the to-be-restrained section 37*b* provided at the second protruding part 37 of the rotatable member 33 is located on the outside of the control rib 13.

In the cable winding device 1 configured as above, the base member 25 has the unwinding cam part 28*c* by which engagement of the sliding part 29*b* of the lever 29 with the unwinding-side rotation-permitting section 36*b* is released or avoided, and by which the lever 29 is permitted to rotate in the unwinding direction relative to the rotatable member 33.

Therefore, an operation of unwinding the cable 100 can be assuredly carried out with a simple structure.

Figure 17:
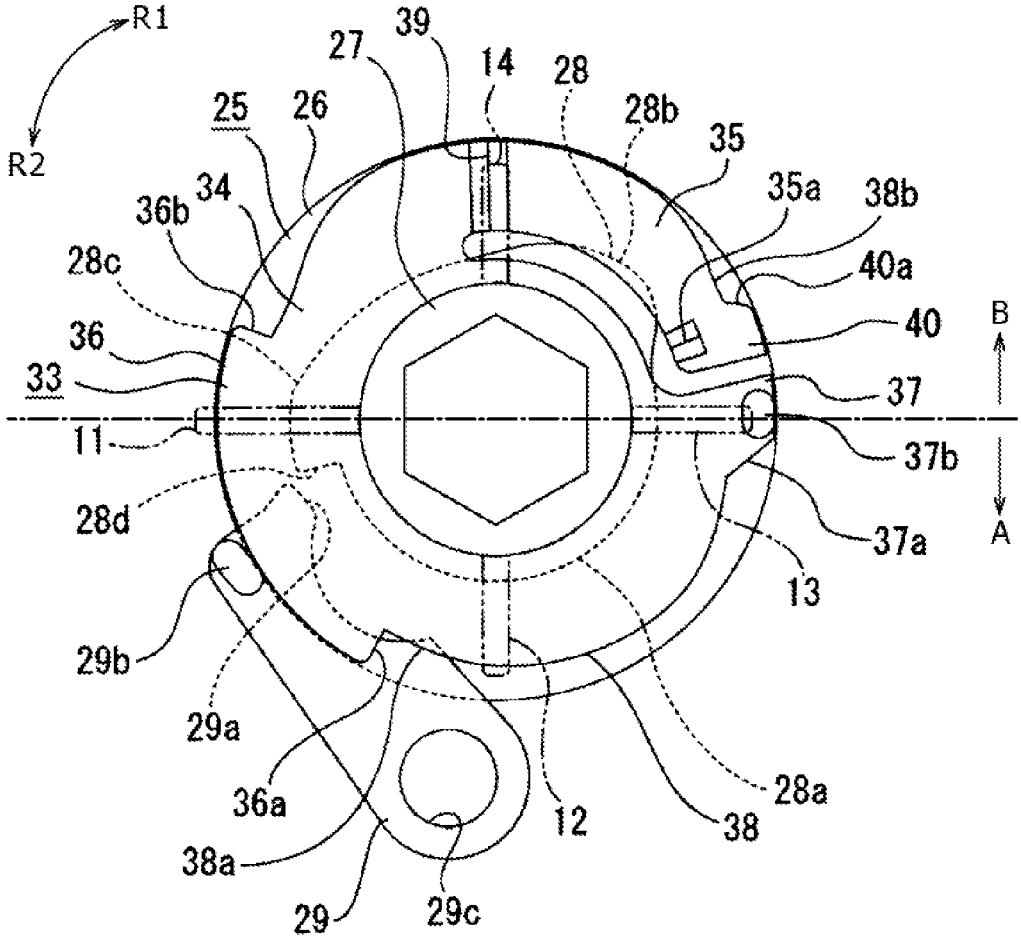
FIG. 17 is an enlarged plan view showing a state in which the cable is unwound subsequently to FIG. 16, and the winding reel and the lever are being rotated.

As the cable 100 continues being unwound, the winding reel 21 and the lever 29 are further rotated in the R2 direction, and the sliding part 29*b* of the lever 29 is let slide on an outer circumferential surface of the first protruding part 36 (see FIG. 17).

Figure 18:
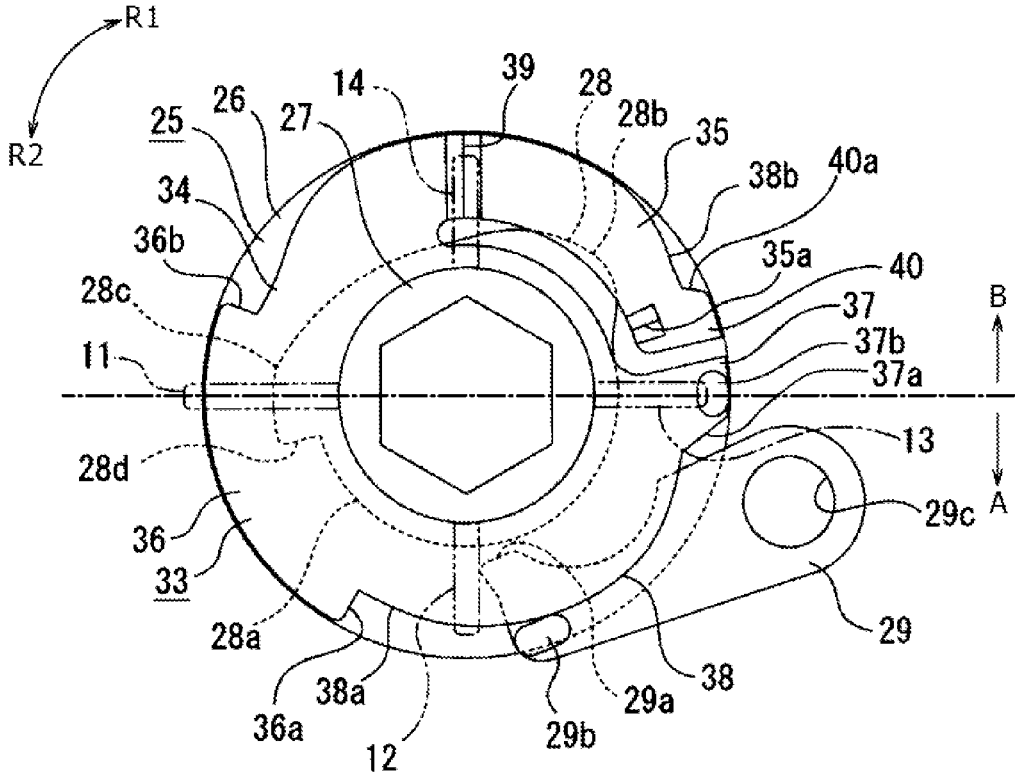
FIG. 18 is an enlarged plan view showing a state in which the unwinding of the cable is finished subsequently to FIG. 17, and the rotation of the winding reel and the lever is stopped.

As the cable 100 is further unwound, the winding reel 21 and the lever 29 are further rotated in the R2 direction (see FIG. 18).

Thereafter, the winding reel 21 and the lever 29 are rotated in the R2 direction in association with the unwinding of the cable 100.

<Stop Mode after Unwinding>

Now, the stop mode after unwinding of the cable 100 will be described below (see FIGS. 18 to 21). The stop mode after unwinding is a mode in which winding of the cable 100 is restrained in a condition where the cable 100 has been unwound by a predetermined length.

In the stop mode after unwinding, initially, the control part 35*a* provided at the displaceable section 35 of the rotatable member 33 is located between the control rib 13 and the second reinforcement rib 14 in the second region B (see FIG. 18).

Figure 19:
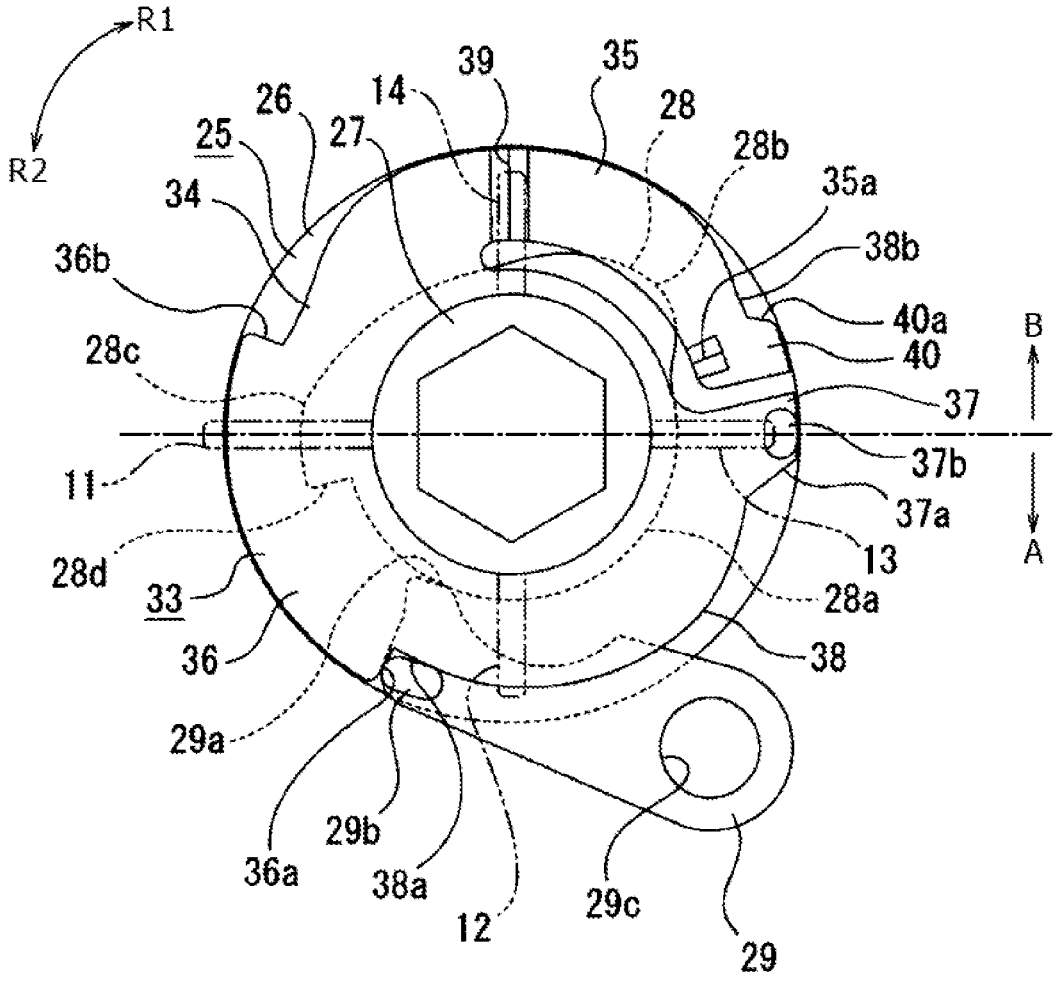
FIG. 19 is an enlarged plan view showing a state in which, after the unwinding of the cable is finished subsequently to FIG. 18, the winding reel and the lever are rotated in a direction reverse to that in FIG. 18, and the sliding part of the lever is engaged with a winding-side rotation permitting section of the rotatable member.

When the unwinding of the cable 100 is finished, the winding reel 21 and the lever 29 are rotated in the R1 direction by the biasing force of the biasing member, and the sliding part 29*b* of the lever 29 is engaged with the winding-side rotation-permitting section 36*a* of the first protruding part 36 and the first engagement part 38*a* of the active surface 38 of the rotatable member 33 (see FIG. 19).

Figure 20:
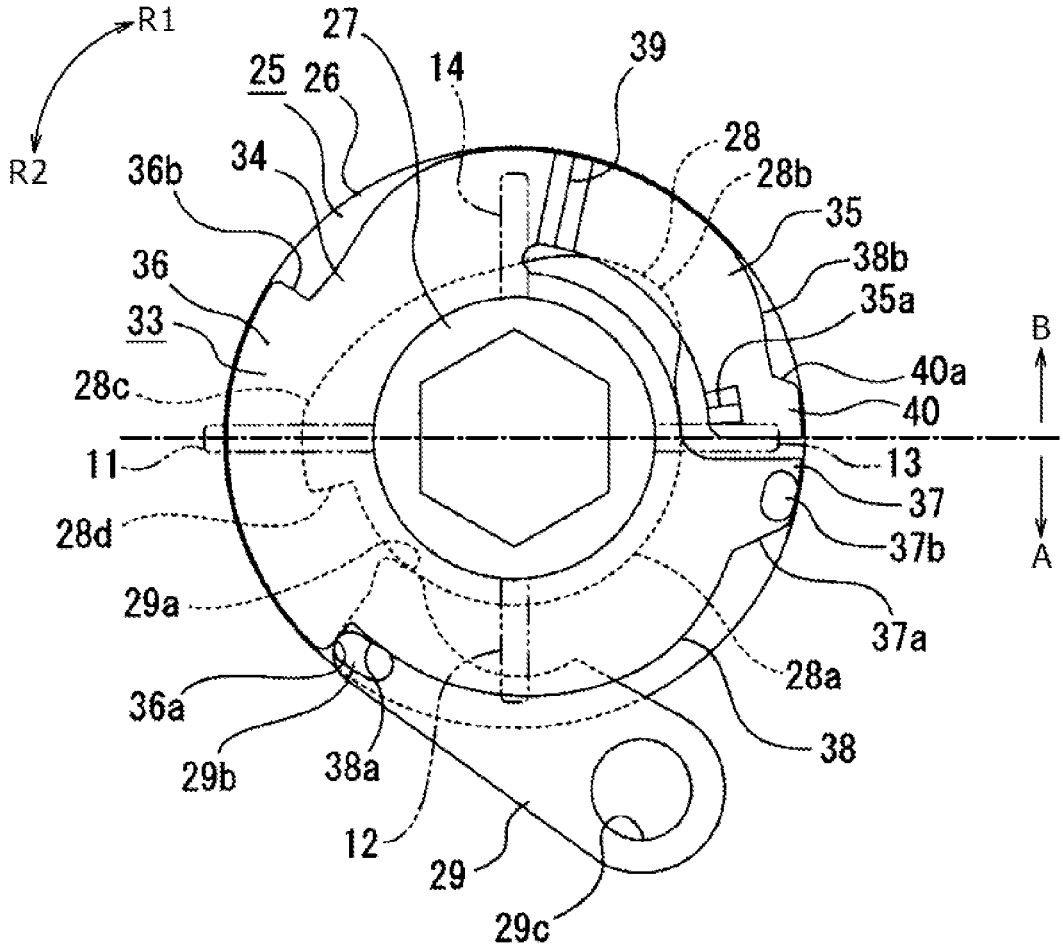
FIG. 20 is an enlarged plan view showing a state in which the rotatable member is being rotated attendant on the rotation of the winding reel and the lever subsequently to FIG. 19.

When the sliding part 29*b* of the lever 29 is engaged with the winding-side rotation-permitting section 36*a*, the rotatable member 33 is rotated in the R1 direction as the winding reel 21 and the lever 29 are rotated in the R1 direction (see FIG. 20).

Figure 21:
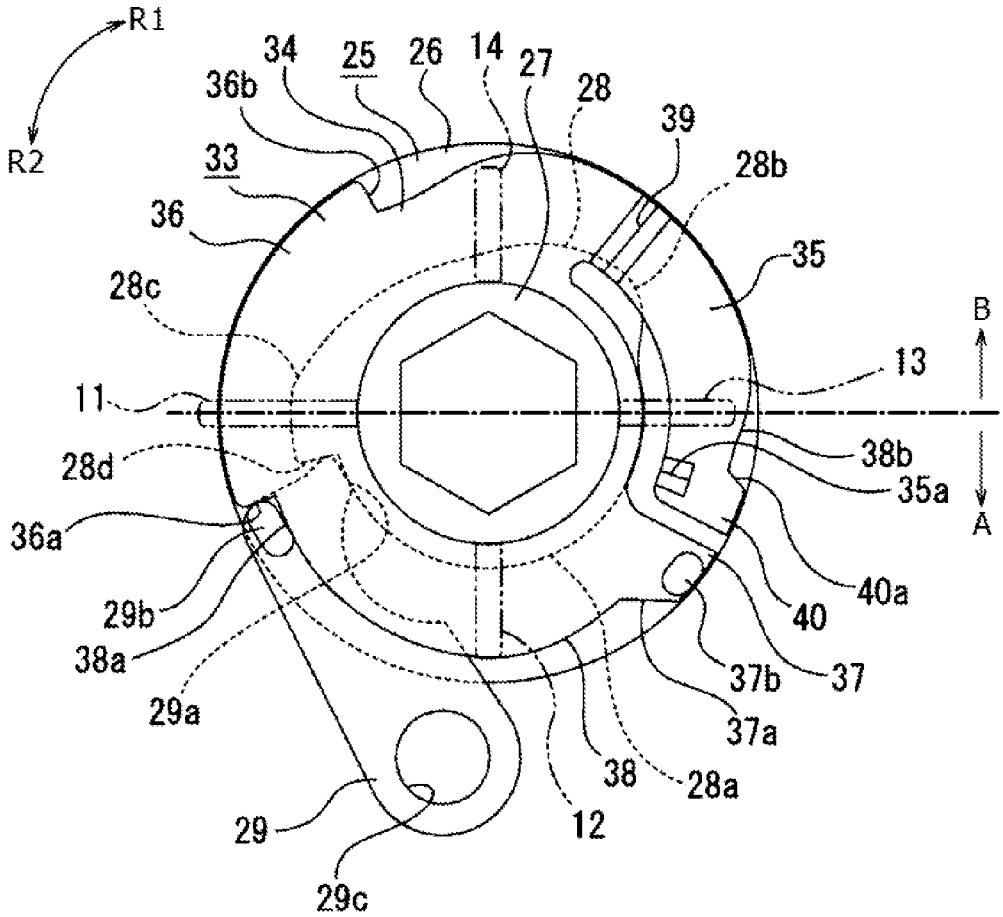
FIG. 21 is an enlarged plan view showing a state in which the rotation of the winding reel and the lever is restrained subsequently to FIG. 20.

As the winding reel 21 and the lever 29 are rotated in the R1 direction, further, the rotatable member 33 is rotated in the R1 direction (see FIG. 21). In this instance, since the lever 29 is not located on the lower side of the displaceable section 35, the displaceable section 35 is elastically deformed, and the control part 35*a* is let slide on the lower edge of the control rib 13, to be moved into the first region A.

The to-be-stopped part 29*a* of the lever 29 is engaged with the rotation-restraining part 28*d* of the base member 25, whereby the winding reel 21 and the lever 29 are restrained from being rotated in the R1 direction, and the winding of the cable 100 is restrained in a condition where the cable 100 has been unwound by a predetermined length.

Thus, in the cable winding device 1, the outer circumferential surface of the rotatable member 33 is formed as the active surface 38 brought into sliding contact with the sliding part 29*b* of the lever 29. In addition, the sliding part 29*b* is engaged with the first engagement part 38*a* which is smaller than an outermost circumference of the rotatable member 33 in radial distance from the fulcrum axis 33*a*, and the to-be-stopped part 29*a* is engaged with the rotation-restraining part 28*d*.

Accordingly, the to-be-stopped part 29*a* of the lever 29 is assuredly engaged with the rotation-restraining part 28*d* of the base member 25, and the stop mode can be set easily and reliably.

<Winding Mode>

Now, the winding mode in which the cable 100 is wound up will be described below (see FIGS. 22 to 27). The winding mode is a mode in which the cable 100 is wound up onto the winding reel 21.

In the winding mode, the control part 35*a* provided at the displaceable section 35 of the rotatable member 33 is located in the first region A.

Figure 22:
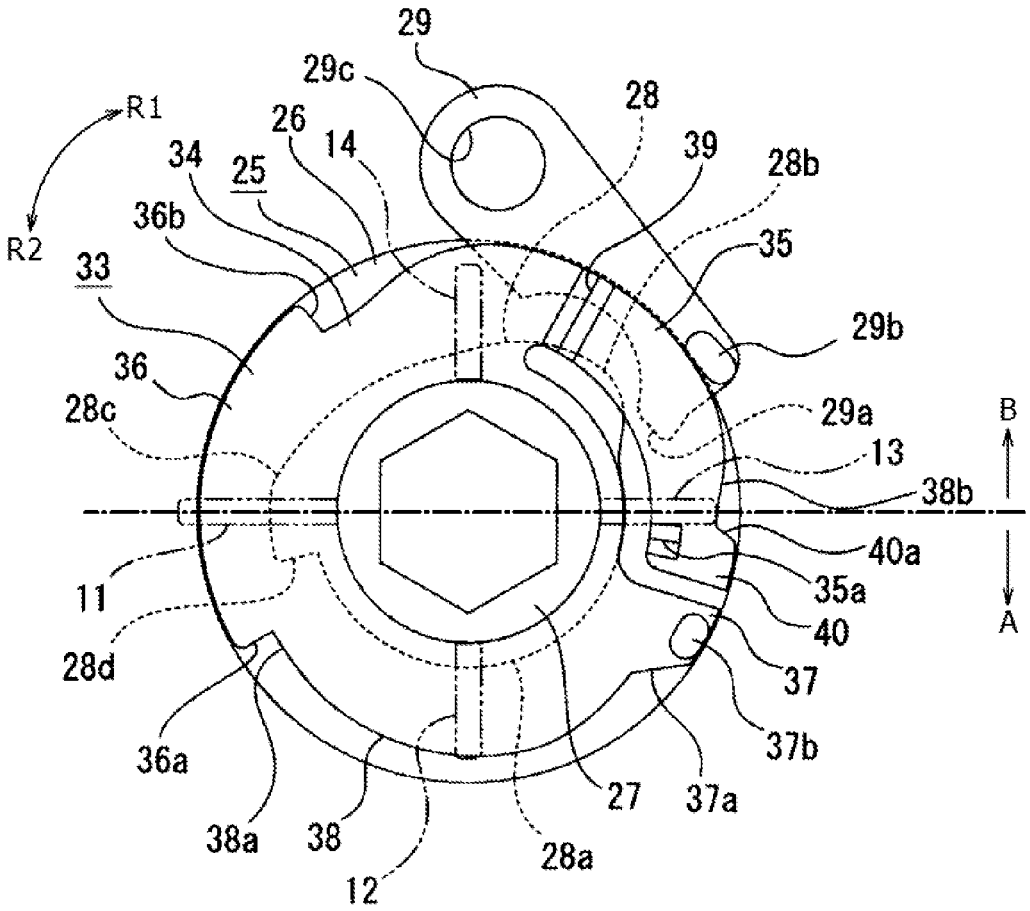
FIG. 22 is an enlarged plan view showing a state in which the cable is once unwound for winding of the cable subsequently to FIG. 21, and the sliding part of the lever is moved to a position beyond a third projection of the rotatable member.
Figure 23:
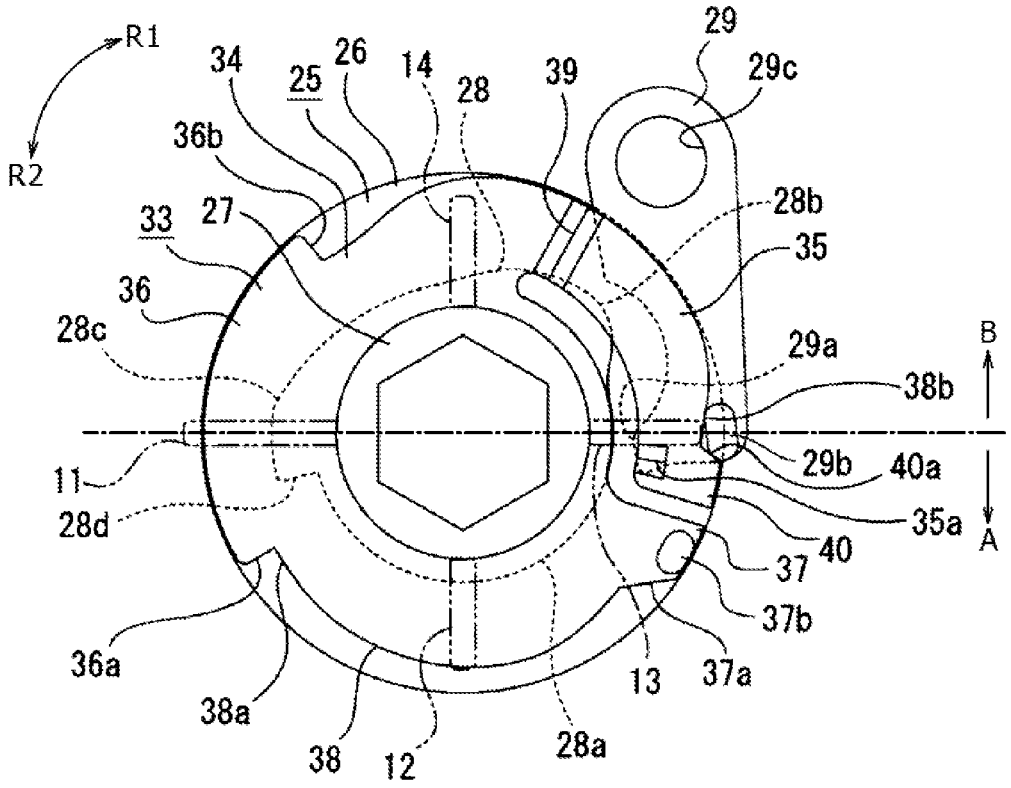
FIG. 23 is an enlarged plan view showing a state in which the cable is wound subsequently to FIG. 22, the winding reel and the lever are rotated, and the sliding part of the lever is engaged with a second engaging surface of the rotatable member.
Figure 24:
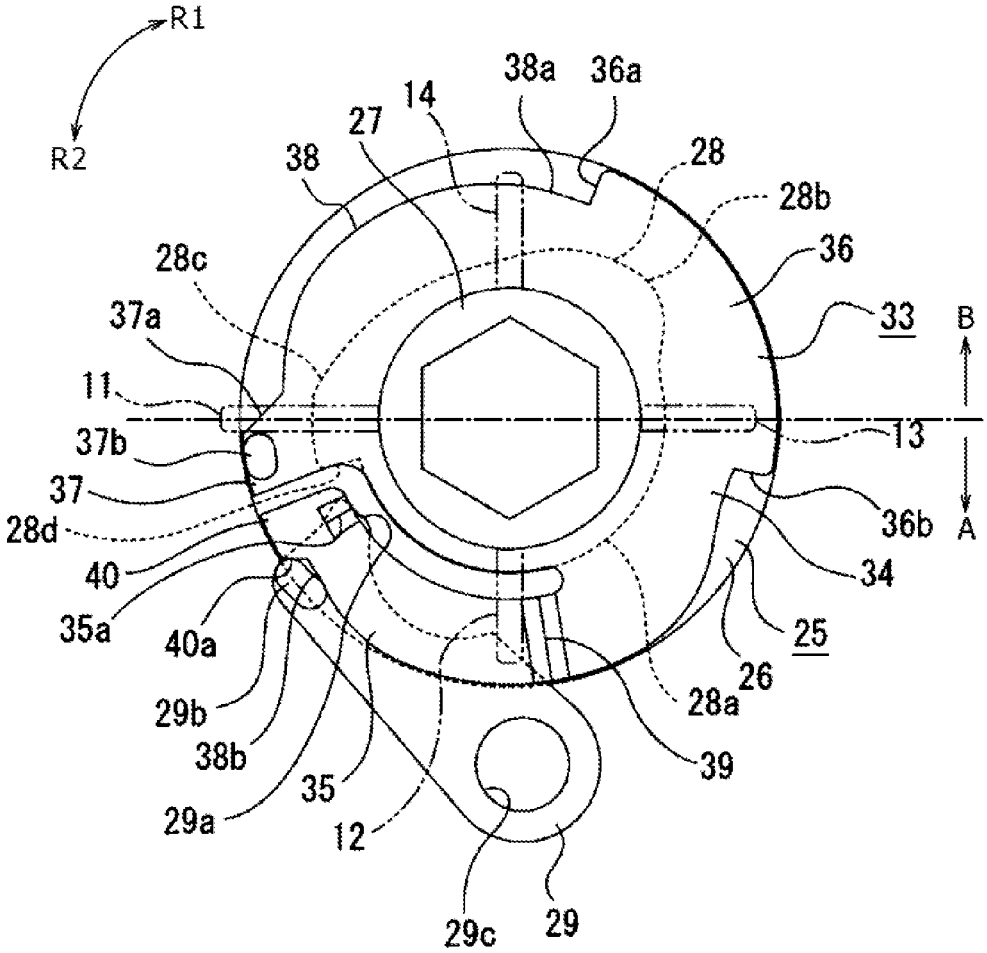
FIG. 24 is an enlarged plan view showing a state in which the cable is wound subsequently to FIG. 23, and a to-be-restrained section of the rotatable member is engaged with a restraint rib, whereby the rotation of the rotatable member is restrained.

In the case of winding the cable 100, the cable 100 is once unwound by a predetermined length, starting from the state in the stop mode, and the winding reel 21 and the lever 29 are rotated in the R2 direction (see FIG. 22). The unwinding of the cable 100 is performed until the sliding part 29*b* of the lever 29 is moved to a position on the R2 direction side relative to the third protruding part 40. At the time of this rotation of the winding reel 21 and the lever 29, the sliding part 29*b* is engaged with the first engagement surface 37*a* of the second protruding part 37, and the rotatable member 33 is rotated in the R2 direction attendantly on the rotation of the lever 29. Then, the control part 35*a* comes into contact with the control rib 13, whereby the rotatable member 33 is restrained from being rotated in the R2 direction. Subsequently, the sliding part 29*b* rides onto the third protruding part 40 from the second protruding part 37, and is moved to the position on the R2 direction side relative to the third protruding part 40.

Next, when the unwinding of the cable 100 is stopped, the winding reel 21 and the lever 29 are rotated in the R1 direction by the biasing force of the biasing member, whereby winding of the cable 100 around the winding reel 21 is performed. In this instance, the sliding part 29*b* of the lever 29 is engaged with the second engagement surface 40*a* of the third protruding part 40 and the second engagement part 38*b* of the active surface 38, of the rotatable member 33 (see FIG. 23).

Of the cable 100, the two parts on the opposite sides of the intermediate portion 100*a* can be simultaneously wound up. Therefore, the cable 100 can be wound up speedily, which promises enhanced convenience in use of the cable winding device 1.

Then, the winding reel 21 and the lever 29 continue being rotated in the R1 direction. In this case, since the sliding part 29*b* of the lever 29 is in engagement with the second engagement surface 40*a*, the rotatable member 33 is rotated in the R1 direction as the winding reel 21 and the lever 29 are rotated in the R1 direction (see FIG. 24). When the rotatable member 33 is rotated in the R1 direction, the control part 35*a* is moved through the passing cutout 12*a* of the first reinforcement rib 12 to the side of the restraint rib 11, and the rotatable member 33 is restrained from being rotated in the R1 direction because the to-be-restrained section 37*b* provided at the second protruding part 37 thereof makes contact with the restraint rib 11.

Thus, in the cable winding device 1, the to-be-restrained section 37*b* of the rotatable member 33 makes contact with the restraint rib 11, whereby the rotatable member 33 is restrained from being rotated in the R1 direction.

Therefore, the control part 35*a* of the rotatable member 33 is maintained in the first region A, without being moved from the first region A into the second region B. Accordingly, the winding mode in which the control part 35*a* is held in the first region A would not be canceled, and winding of the cable 100 can be carried out assuredly.

In addition, since the restraint rib 11 is located over the range from an innermost circumference to the outermost circumference of the rotatable member 33, the to-be-restrained section 37*b* is engaged with the restraint rib 11 assuredly and, therefore, the cable 100 can be wound up with enhanced reliability.

Figure 25:
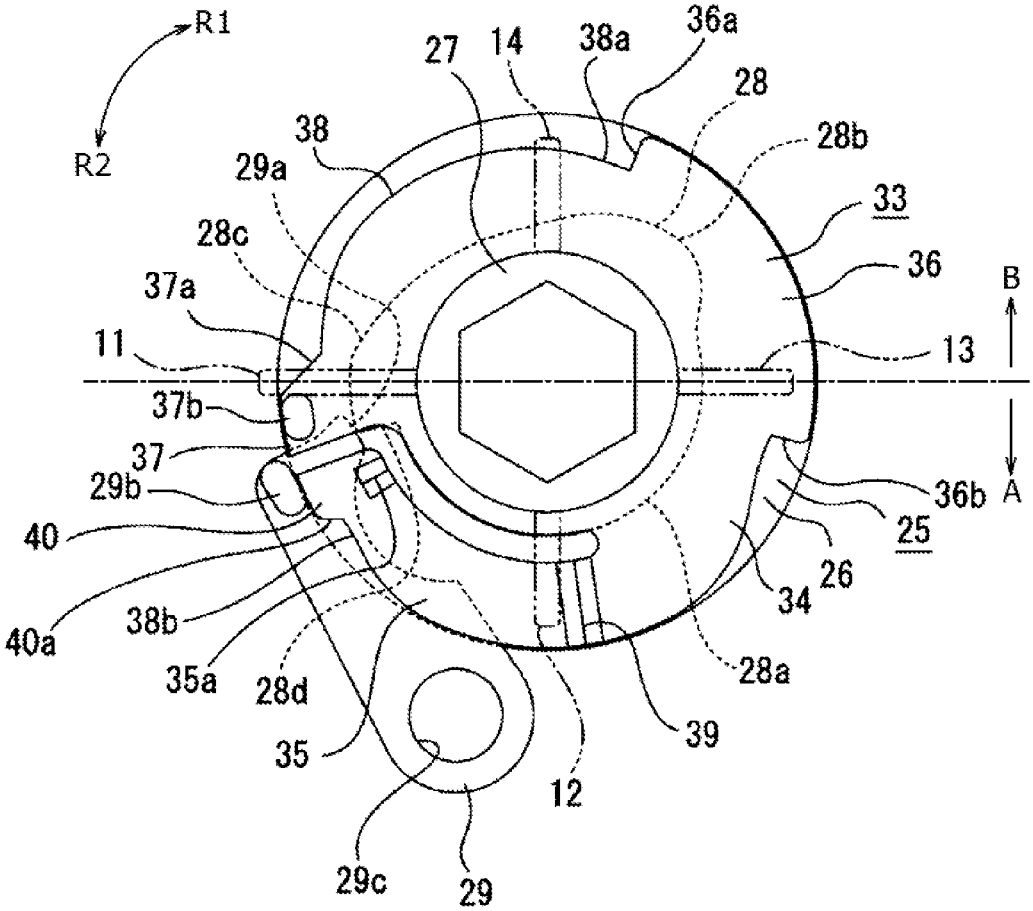
FIG. 25 is an enlarged plan view showing a state in which the cable is wound subsequently to FIG. 24, the winding reel and the lever are rotated, and the sliding part of the lever has ridden onto the third projection of the rotatable member.

As the winding reel 21 and the lever 29 continue being rotated in the R1 direction and the cable 100 is wound attendantly, the sliding part 29*b* of the lever 29 rides onto the second protruding part 37 from the third protruding part 40, and the lever 29 is turned outward against the biasing force of the biasing spring 30 (see FIG. 25). Since the lever 29 is thus turned outward, the to-be-stopped part 29*a* is passed on the outside of the rotation-restraining part 28*d* of the base member 25.

Figure 26:
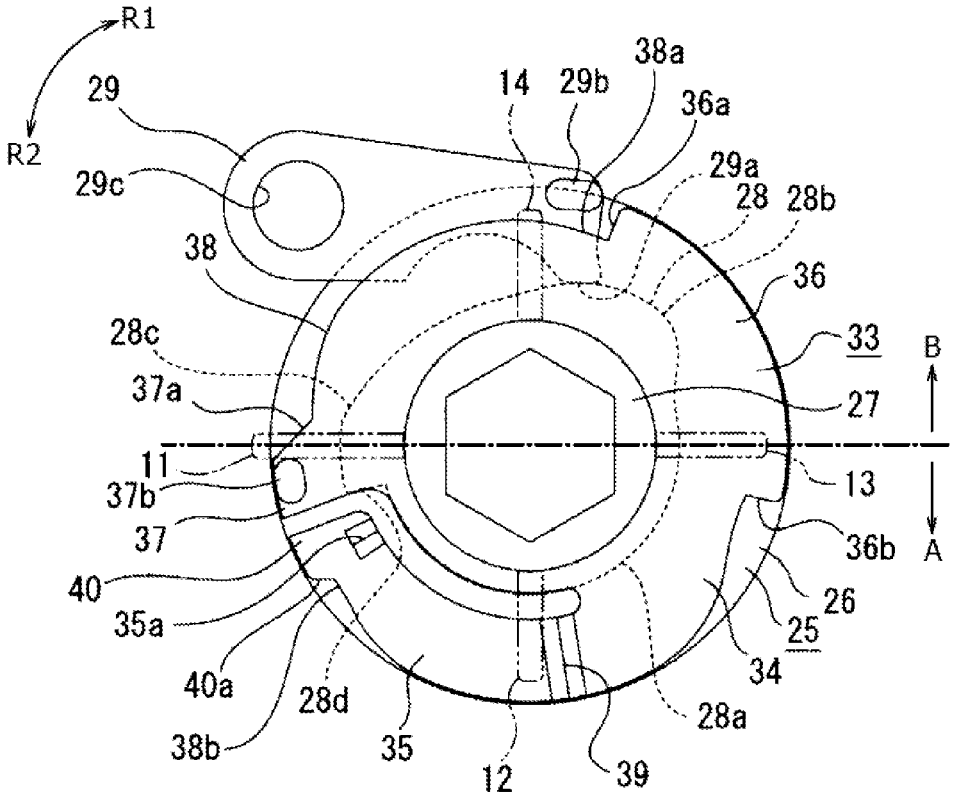
FIG. 26 is an enlarged plan view showing a state in which the cable is wound subsequently to FIG. 25, the winding reel and the lever are rotated, and a to-be-stopped part of the lever is slid on a winding cam part of the base member.
Figure 27:
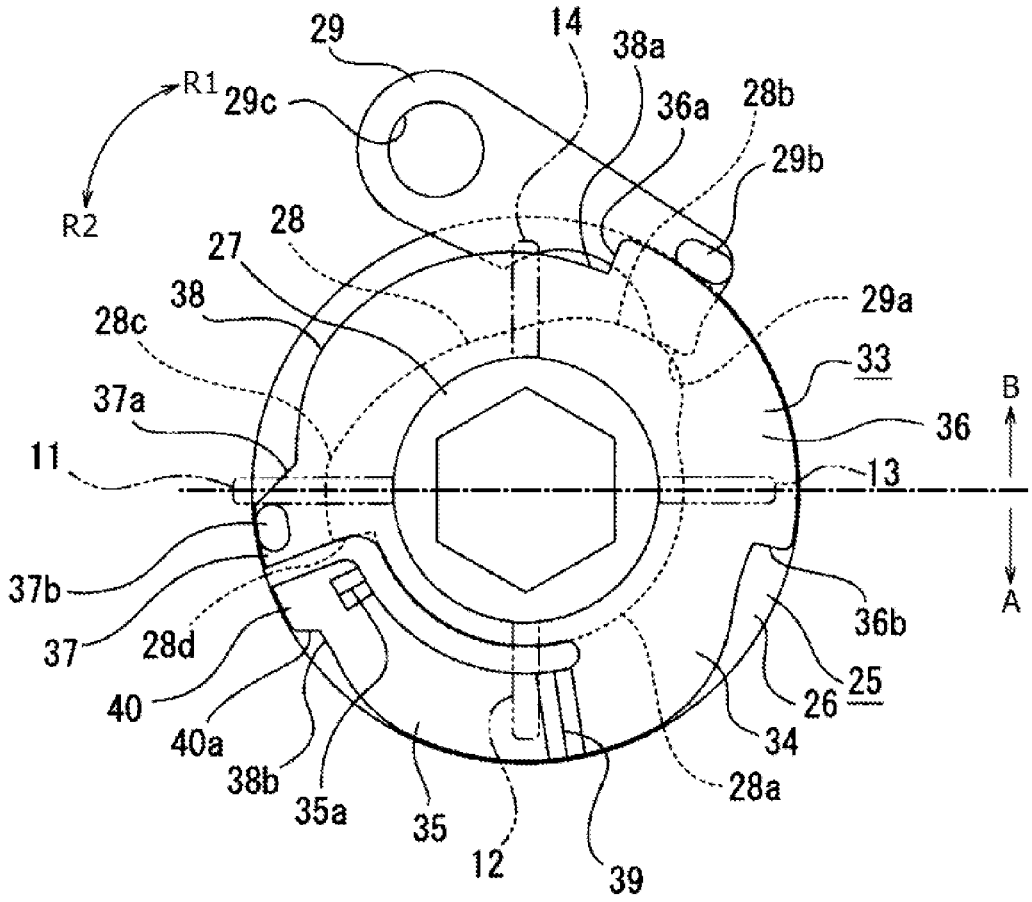
FIG. 27 is an enlarged plan view showing a state in which the cable is wound subsequently to FIG. 26, and the winding reel and the lever are being rotated.

The winding reel 21 and the lever 29 are further rotated in the R1 direction, and the to-be-stopped part 29*a* of the lever 29 is let slide sequentially on the unwinding cam part 28*c* and the winding cam part 28*b* of the base member 25 (see FIG. 26).

The lever 29 is turned outward against the biasing force of the biasing spring 30, since its to-be-stopped part 29*a* is let slide on the winding cam part 28*b*. With its sliding part 29*b* kept out of contact with the winding-side rotation-permitting section 36*a* of the rotatable member 33, the lever 29 is rotated in the R1 direction together with the winding reel 21 (see FIG. 27).

Thus, in the cable winding device 1, the base member 25 has the winding cam part 28*b* by which engagement of the sliding part 29*b* of the lever 29 with the winding-side rotation-permitting section 36*a* is released or avoided, and by which the lever 29 is permitted to be rotated in the winding direction relative to the rotatable member 33.

Therefore, the operation of winding up the cable 100 can be assuredly carried out with a simple structure.

Thereafter, the winding reel 21 and the lever 29 are rotated in the R1 direction by the biasing force of the biasing member, and the cable 100 is wound up accordingly.

[Summarizing]

As has been described above, in the cable winding device 1, winding of the cable 100 is controlled according to the position of the control part 35*a* of the rotatable member 33 relative to the control rib 13 which is located on the locus of rotation of the rotatable member 33.

Therefore, winding of the cable 100 is controlled by controlling the position of the control part 35*a* without using a spherical element that functions as a bearing. Accordingly, reliability of operation can be secured while ensuring a simplified mechanism and enhanced durability.

The control part 35*a* of the rotatable member 33 is moved from the first region A into the second region B at the time of unwinding of the cable 100, and is moved from the second region B into the first region A at the time of stopping after unwinding. This ensures that the position of the control part 35*a* is assuredly changed according to the operation on the cable 100, which promises enhanced reliability of operation in the unwinding mode and the stop mode.

When the rotatable member 33 is rotated in the winding direction by the biasing force of the biasing member and the control part 35*a* is moved from the second region B into the first region A, the to-be-stopped part 29*a* is engaged with the rotation-restraining part 28*d* of the base member 25, whereby rotation of the winding reel 21 in the winding direction is restrained.

Therefore, rotation of the winding reel 21 is securely restrained by the movement of the control part 35*a* of the rotatable member 33. This ensures enhanced reliability of operation in the stop mode.

In the condition where the control part 35*a* of the rotatable member 33 is located in the first region A, the winding reel 21 is rotated in the winding direction by the biasing force of the biasing member and the cable 100 is thereby wound up.

Therefore, winding of the cable 100 is securely performed according to the position of the control part 35*a* of the rotatable member 33, which promises enhanced reliability of operation in the winding mode.

The lever 29 is turnably supported on the winding reel 21, and the biasing spring 30 is provided by which the lever 29 is biased in the direction for the sliding part 29*b* to be pressed against the active surface 38 of the rotatable member 33.

Therefore, the sliding part 29*b* of the lever 29 is let slide on the active surface 38 in an assured manner, whereby reliability of operation in each mode can be enhanced.

The rotatable member 33 has the displaceable section 35 which can be elastically deformed, and, when the rotatable member 33 is rotated, the displaceable section 35 is elastically deformed, whereby the control part 35*a* is moved on the opposite sides of the control rib 13.

Therefore, the movement of the control part 35*a* of the rotatable member 33 is effected by the simple operation of elastic deformation of the displaceable section 35. Consequently, enhanced reliability of operation can be promised while ensuring a simplified mechanism.

Part of the lever 29 is disposed between the base member 25 and the rotatable member 33 so that elastic deformation of the displaceable section 35 is restrained by the disposition of the lever 29 between the base member 25 and the displaceable section 35 of the rotatable member 33.

Therefore, there is no need for any member for exclusive use to restrain elastic deformation of the displaceable section 35 of the rotatable member 33. Accordingly, each operation on the cable 100 can be effected with a simple mechanism while ensuring a reduction in the number of component parts.

Incidentally, while an example in which an HDMI cable being large in thickness and weight is used as the cable 100 has been described above, the structure in the cable winding device 1 is especially effective for a type of dealing with a cable that requires a large force at the time of unwinding, such as the HDMI cable which is large in thickness and weight.

[Present Technology]

The present technology can be embodied in the following configurations.

(1) A cable winding device including: a base member disposed in a fixed state; a winding reel that is connected to part of a cable and that can be rotated relative to the base member in a cable winding direction and a cable unwinding direction reverse to the cable winding direction; a lever supported on the winding reel and rotated together with the winding reel relative to the base member; a biasing member biasing the winding reel in the winding direction; a rotatable member that is disposed to face the base member, that can be rotated relative to the base member with a fulcrum axis as a fulcrum, the fulcrum axis being located coaxially with a rotational axis of the winding reel, and that has a control part operative to control winding of the cable; and a control rib located on a locus of rotation of the rotatable member, in which the winding of the cable is controlled according to the position of the control part relative to the control rib.

(2) The cable winding device as described in the above paragraph (1), in which regions on circumferentially opposite sides of the control rib are respectively a first region and a second region, the rotatable member is rotated and the control part is moved from the first region into the second region when the cable is unwound and the winding reel is rotated in the unwinding direction, and the control part is moved from the second region into the first region when the rotatable member is rotated in the winding direction by a biasing force of the biasing member in a condition where the control part has been moved from the first region into the second region.

(3) The cable winding device as described in the above paragraph (2), in which the base member has a rotation-restraining part, the lever has a to-be-stopped part, and when the rotatable member is rotated in the winding direction and the control part is moved from the second region into the first region, the to-be-stopped part is engaged with the rotation-restraining part, whereby the winding reel is restrained from being rotated in the winding direction.

(4) The cable winding device as described in the above paragraph (2) or (3), in which, in a condition where the control part is located in the first region, the winding reel is rotated in the winding direction by the biasing force of the biasing member, whereby the cable is wound.

(5) The cable winding device as described in the above paragraph (4), in which the rotatable member has a to-be-restrained section, a restraint rib that can be engaged with the to-be-restrained section and that restrains rotation of the rotatable member when in engagement with the to-be-restrained section is provided between the first region and the second region, and the to-be-restrained section is engaged with the restraint rib and the control part is held in the first region when the rotatable member is rotated during winding of the cable.

(6) The cable winding device as described in the above paragraph (5), in which the restraint rib is formed in a shape extending in a radial direction of the rotatable member, and the restraint rib is located over a range from an innermost circumference to an outermost circumference of the rotatable member.

(7) The cable winding device as described in the above paragraph (5) or (6), in which the control rib and the restraint rib are located on opposite sides of the rotational axis.

(8) The cable winding device as described in any of the above paragraphs (3) to (7), in which the lever has a sliding part, an outer circumferential surface of the rotatable member is an active surface to be slidably engaged with the sliding part of the lever, the active surface has an engagement part that is smaller than the outermost circumference of the rotatable member in radial distance from the fulcrum axis, and the to-be-stopped part is engaged with the rotation-restraining part through engagement of the sliding part of the lever with the engagement part.

(9) The cable winding device as described in the above paragraph (8), in which the lever is turnably supported on the winding reel, and a biasing spring configured to bias the lever in a direction for the sliding part to be pressed against the active surface is provided.

(10) The cable winding device as described in any of the above paragraphs (1) to (9), in which the rotatable member has a displaceable section that includes the control part and that is elastically deformable in directions for coming closer to and away from the control rib, and the displaceable section is elastically deformed when the rotatable member is rotated, whereby the control part is let slide on the control rib and is moved on both sides of the control rib.

(11) The cable winding device as described in any of the above paragraphs (4) to (10), in which the rotatable member has the displaceable section that includes the control part and that is elastically deformable in the directions for coming closer to and away from the control rib, the displaceable section is elastically deformed when the rotatable member is rotated, whereby the control part is let slide on the control rib and is moved on both sides of the control rib, part of the lever is disposed between the base member and the rotatable member, and, when the control part is located in the first region and the lever is located between the base member and the displaceable section of the rotatable member, elastic deformation of the displaceable section is restrained by the lever and the control part is held in the first region.

(12) The cable winding device as described in any of the above paragraphs (2) to (11), in which the rotatable member has an unwinding-side rotation-permitting section that is engaged with the sliding part and that permits rotation of the rotatable member and the lever as one body in the unwinding direction, and the base member has an unwinding cam part that releases or avoids engagement of the sliding part with the unwinding-side rotation-permitting section so as to permit the lever to be rotated in the unwinding direction relative to the rotatable member.

(13) The cable winding device as described in any of the above paragraphs (2) to (12), in which the rotatable member has a winding-side rotation-permitting section that is engaged with the sliding part and that permits rotation of the rotatable member and the lever as one body in the winding direction, and the base member has a winding cam part that releases or avoids engagement of the sliding part with the winding-side rotation-permitting section so as to permit the lever to be rotated in the winding direction relative to the rotatable member.

(14) The cable winding device as described in any of the above paragraphs (1) to (13), in which a cover case that covers at least part of the cable is provided, and the cover case is integrally formed with the control rib.

(15) The cable winding device as described in any of the above paragraphs (5) to (14), in which the cover case that covers at least part of the cable is provided, and the cover case is integrally formed with the restraint rib.

(16) The cable winding device as described in the above paragraph (15), in which the control rib and the restraint rib are provided as reinforcement ribs configured to reinforce the cover case.

(17) The cable winding device as described in any of the above paragraphs (1) to (16), in which the winding reel has a first winding tube section and a second winding tube section that are located coaxially with each other, and different parts of the cable can be wound respectively around the first winding tube section and the second winding tube section.

(18) The cable winding device as described in the above paragraph (17), in which the different parts of the cable can be simultaneously wound and unwound.

The specific shapes and structures of the components and sections or parts shown in the best mode for carrying out the present technology as described above are merely specific examples in carrying out the present technology, and they are not to be construed as restrictive of the technical scope of the present technology.

What is claimed is:

1. A cable winding device comprising:

a base member disposed in a fixed state;

a winding reel that is connected to part of a cable and that can be rotated relative to the base member in a cable winding direction and a cable unwinding direction reverse to the cable winding direction;

a lever supported on the winding reel and rotated together with the winding reel relative to the base member;

a biasing member biasing the winding reel in the winding direction;

a rotatable member that is disposed to face the base member, that can be rotated relative to the base member with a fulcrum axis as a fulcrum, the fulcrum axis being located coaxially with a rotational axis of the winding reel, and that has a control part operative to control winding of the cable; and a control rib located on a locus of rotation of the rotatable member, wherein the winding of the cable is controlled according to the position of the control part relative to the control rib.

2. The cable winding device according to claim 1, wherein regions on circumferentially opposite sides of the control rib are a first region and a second region, respectively, when the cable is unwound and the winding reel is rotated in the unwinding direction, the rotatable member is rotated and the control part is moved from the first region into the second region, and the control part is moved from the second region into the first region when the rotatable member is rotated in the winding direction by a biasing force of the biasing member in a condition where the control part has been moved from the first region into the second region.

3. The cable winding device according to claim 2, wherein the base member has a rotation-restraining part, the lever has a to-be-stopped part, and when the rotatable member is rotated in the winding direction and the control part is moved from the second region into the first region, the to-be-stopped part is engaged with the rotation-restraining part, whereby the winding reel is restrained from being rotated in the winding direction.

4. The cable winding device according to claim 3, wherein the lever has a sliding part, an outer circumferential surface of the rotatable member is an active surface to be slidably engaged with the sliding part of the lever, the sliding part is engaged with an engagement part that is smaller than an outermost circumference of the rotatable member in radial distance from the fulcrum axis, and the to-be-stopped part is engaged with the rotation-restraining part through engagement of the sliding part of the lever with the engagement part.

5. The cable winding device according to claim 4, wherein the lever is turnably supported on the winding reel, and a biasing spring configured to bias the lever in a direction for the sliding part to be pressed against the active surface is provided.

6. The cable winding device according to claim 2, wherein, in a condition where the control part is located in the first region, the winding reel is rotated in the winding direction by the biasing force of the biasing member, whereby the cable is wound.

7. The cable winding device according to claim 6, wherein the rotatable member has a to-be-restrained section, a restraint rib that can be engaged with the to-be-restrained section and that restrains rotation of the rotatable member when in engagement with the to-be-restrained section is provided between the first region and the second region, and when the rotatable member is rotated during winding of the cable, the to-be-restrained section is engaged with the restraint rib and the control part is held in the first region.

8. The cable winding device according to claim 7, wherein the restraint rib is formed in a shape extending in a radial direction of the rotatable member, and the restraint rib is located over a range from an innermost circumference to the outermost circumference of the rotatable member.

9. The cable winding device according to claim 7, wherein the control rib and the restraint rib are located on opposite sides of the rotational axis.

10. The cable winding device according to claim 7, wherein a cover case that covers at least part of the cable is provided, and the cover case is integrally formed with the restraint rib.

11. The cable winding device according to claim 10, wherein the control rib and the restraint rib are provided as reinforcement ribs configured to reinforce the cover case.

12. The cable winding device according to claim 6, wherein the rotatable member has a displaceable section that includes the control part and that is elastically deformable in directions for coming closer to and away from the control rib, when the rotatable member is rotated, the displaceable section is elastically deformed, whereby the control part is let slide on the control rib and is moved into the first region or the second region, part of the lever is disposed between the base member and the rotatable member, and when the control part is located in the first region and the lever is located between the base member and the displaceable section of the rotatable member, elastic deformation of the displaceable section is restrained by the lever and the control part is held in the first region.

13. The cable winding device according to claim 2, wherein the rotatable member has an unwinding-side rotation-permitting section that is engaged with the sliding part and that permits rotation of the rotatable member and the lever as one body in the unwinding direction, and the base member has an unwinding cam part that releases or avoids engagement of the sliding part with the unwinding-side rotation-permitting section so as to permit the lever to be rotated in the unwinding direction relative to the rotatable member.

14. The cable winding device according to claim 2, wherein the rotatable member has a winding-side rotation-permitting section that is engaged with the sliding part and that permits rotation of the rotatable member and the lever as one body in the winding direction, and the base member has a winding cam part that releases or avoids engagement of the sliding part with the winding-side rotation-permitting section so as to permit the lever to be rotated in the winding direction relative to the rotatable member.

15. The cable winding device according to claim 1, wherein the rotatable member has a displaceable section that includes the control part and that is elastically deformable in directions for coming closer to and away from the control rib, and when the rotatable member is rotated, the displaceable section is elastically deformed, whereby the control part is let slide on the control rib and is moved into a first region or a second region of the control rib.

16. The cable winding device according to claim 1, wherein the cover case that covers at least part of the cable is provided, and the cover case is integrally formed with the control rib.

17. The cable winding device according to claim 1, wherein the winding reel has a first winding tube section and a second winding tube section that are located coaxially with each other, and different parts of the cable can be wound respectively around the first winding tube section and the second winding tube section.

18. The cable winding device according to claim 17, wherein the different parts of the cable can be simultaneously wound and unwound.

* * * * *